US010990057B2

(12) United States Patent
Sekiya et al.

(10) Patent No.: US 10,990,057 B2
(45) **Date of Patent: *Apr. 27, 2021**

(54) IMAGE FORMING APPARATUS AND PROCESS CARTRIDGE

(71) Applicant: FUJI XEROX CO., LTD., Tokyo (JP)

(72) Inventors: Jun Sekiya, Kanagawa (JP); Tatsuhiro Igarashi, Kanagawa (JP); Yasuhisa Morooka, Kanagawa (JP); Yuma Kubo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/822,725

(22) Filed: Mar. 18, 2020

(65) Prior Publication Data

US 2021/0088960 A1 Mar. 25, 2021

(30) Foreign Application Priority Data

Sep. 24, 2019 (JP) ..... JP2019-172845

(51) Int. Cl.
*G03G 21/00* (2006.01)
*G03G 9/097* (2006.01)
(Continued)

(52) U.S. Cl.
CPC ..... *G03G 21/0017* (2013.01); *G03G 9/0821* (2013.01); *G03G 9/0825* (2013.01);
(Continued)

(58) Field of Classification Search
CPC ..... G03G 21/0011; G03G 21/0017; G03G 21/0029; G03G 9/0821; G03G 9/0825;
(Continued)

(56) References Cited

U.S. PATENT DOCUMENTS

2004/0191666 A1* 9/2004 Kamada ..... G03G 15/08 430/119.88
2006/0040195 A1* 2/2006 Miyakawa ..... G03G 9/09725 430/108.7
(Continued)

FOREIGN PATENT DOCUMENTS

JP 2004361844 A * 12/2004
JP 2006-243235 A 9/2006
(Continued)

OTHER PUBLICATIONS

Machine Translation of JP2004-361844. Dec. 24, 2004. (Year: 2004).*

*Primary Examiner* — Carla J Therrien
(74) *Attorney, Agent, or Firm* — Sughrue Mion, PLLC

(57) ABSTRACT

An image forming apparatus includes an image holding member; a charging unit; an electrostatic image forming unit; a developing unit that includes an electrostatic image developer including a toner and develops the electrostatic image formed on the surface of the image holding member with the electrostatic image developer to form a toner image; a transfer unit; and a cleaning unit that removes toner particles present on the surface of the image holding member. The cleaning unit includes a cleaning blade arranged to contact with the surface of the image holding member. The cleaning unit includes a cleaning blade A containing a contacting portion having a JIS-A hardness of 90° or more, or the cleaning unit includes a control unit B that controls a load with which the cleaning blade contacts with the image holding member, the control unit B controlling the load in a constant load mode. The toner includes toner particles; and silica particles having a number average particle size of 110 nm to 130 nm, a large-diameter-side number particle size distribution index (upper GSDp) of less than 1.080, and an
(Continued)

average circularity of 0.94 to 0.98, wherein 80 number % or more of the silica particles have a circularity of 0.92 or more.

14 Claims, 5 Drawing Sheets

(51) Int. Cl.
*G03G 9/087* (2006.01)
*G03G 9/08* (2006.01)
*G03G 15/02* (2006.01)

(52) U.S. Cl.
CPC ..... *G03G 9/0827* (2013.01); *G03G 9/08711* (2013.01); *G03G 9/09725* (2013.01); *G03G 15/0216* (2013.01); *G03G 21/0029* (2013.01); *G03G 2221/0047* (2013.01)

(58) Field of Classification Search
CPC ..... G03G 9/0827; G03G 9/0819; G03G 9/08711; G03G 9/09725
See application file for complete search history.

(56) References Cited

U.S. PATENT DOCUMENTS

2007/0092821 A1* 4/2007 Sato ..... G03G 9/0819 430/108.4
2012/0189952 A1* 7/2012 Lee ..... G03G 9/08797 430/108.7
2013/0059244 A1* 3/2013 Iwanaga ..... G03G 9/0827 430/105
2018/0239297 A1* 8/2018 Juri ..... G03G 21/1814

FOREIGN PATENT DOCUMENTS

JP 2006-259311 A 9/2006
JP 2011-221437 A 11/2011
JP 2015-022078 A 2/2015

* cited by examiner

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2019-172845 filed Sep. 24, 2019.

BACKGROUND

(i) Technical Field

The present disclosure relates to an image forming apparatus and a process cartridge.

(ii) Related Art

Methods in which image information is converted into an electrostatic image and then visualized, such as electrophotography, have been used in various fields.

One of the common electrophotographic methods is a visualizing method that includes the following plural steps: forming an electrostatic latent image on a photosensitive member or an electrostatic recording medium with by an appropriate method; developing the electrostatic latent image (toner image) by depositing charge detecting particles, which are referred to as "toner particles", to the electrostatic latent image; transferring the toner image onto the surface of the body to which the image is to be transferred; and fixing the image by heating or the like.

Examples of the cleaning apparatuses known in the related art include the cleaning apparatus described in Japanese Laid Open Patent Application Publication No. 2011-221437.

Japanese Laid Open Patent Application Publication No. 2011-221437 discloses a cleaning apparatus that includes an image holding member; a revolving unit that includes a cleaning blade arranged to contact with the image holding member such that the edge of the cleaning blade is pointed in the direction (i.e., "counter direction") opposite to the direction of rotation of the image holding member, a cleaning blade supporting member that supports the cleaning blade and revolves about a rotation pivot, and a weight irremovably attached to the cleaning blade supporting member, the weight being used to apply a predetermined load in a direction in which the cleaning blade contacts with the image holding member; and a load applying unit that applies a load in the direction in which the cleaning blade contacts with the image holding member upon the image holding member being rotated and the revolving unit revolving in the direction opposite to the counter direction while the cleaning blade contacts with the image holding member.

Examples of the image forming methods known in the related art include the image forming method described in Japanese Laid Open Patent Application Publication No. 2006-259311.

Japanese Laid Open Patent Application Publication No. 2006-259311 discloses an electrophotographic image forming method in which a toner image is formed, the method including at least charging, image exposure, developing, transferring, fixing, and cleaning of a photosensitive member. The cleaning step is conducted by a blade cleaning method in which the toner particles that have not been transferred and remain on the photosensitive member are removed with a cleaning blade arranged to contact with the photosensitive member. The cleaning blade has an impact resilience of 50% or more at 23° C. The pressing force at which the cleaning blade contacts with the photosensitive member is 0.20 N/cm or more and 0.70 N/cm or less. The toner includes an external additive. The number average particle size of primary particles of the external additive is 20 to 100 nm. The external additive includes particles having a size of 10 to 20 nm and particles having a size of 200 to 300 nm. The circularity of particles of the toner is 0.94 or more.

SUMMARY

Aspects of non-limiting embodiments of the present disclosure relate to an image forming apparatus that may reduce the occurrence of image defects in the images formed with the image forming apparatus compared with an image forming apparatus that includes a cleaning unit that is the unit A or B described below, wherein external additive particles of the electrostatic image developing toner used in the image forming apparatus are silica particles having a number average particle size of less than 110 nm or more than 130 nm, a large-diameter-side number particle size distribution index (upper GSDp) of 1.080 or more, or an average circularity of less than 0.94 or more than 0.98, or silica particles such that less than 80 number % of the silica particles have a circularity of 0.92 or more.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding member; a charging unit that charges a surface of the image holding member; an electrostatic image forming unit that forms an electrostatic image on the charged surface of the image holding member; a developing unit that includes an electrostatic image developer including a toner and develops the electrostatic image formed on the surface of the image holding member with the electrostatic image developer to form a toner image; a transfer unit that transfers the toner image onto a surface of a recording medium; and a cleaning unit that removes toner particles present on the surface of the image holding member, the cleaning unit including a cleaning blade arranged to contact with the surface of the image holding member, the cleaning unit including a cleaning blade A containing a contacting portion having a JIS-A hardness of 90° or more, or the cleaning unit including a control unit B that controls a load with which the cleaning blade contacts with the image holding member, the control unit B controlling the load in a constant load mode, the toner including toner particles; and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more.

BRIEF DESCRIPTION OF THE DRAWINGS

An exemplary embodiment of the present disclosure will be described in detail based on the following figures, wherein.

DETAILED DESCRIPTION

Figure 1:
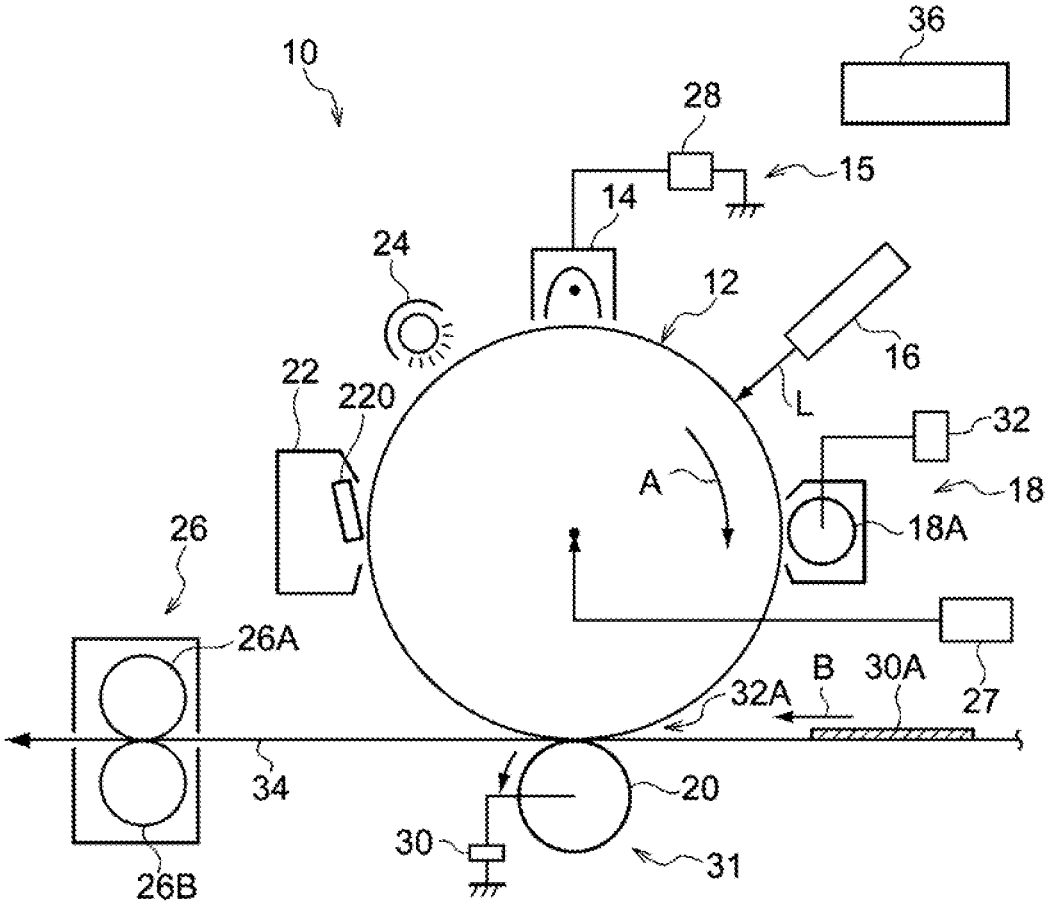
FIG. 1 is a schematic diagram illustrating an example of an image forming apparatus according to an exemplary embodiment.

Hereinafter, when numerical ranges are described in a stepwise manner, the upper or lower limit of a numerical range may be replaced with the upper or lower limit of another numerical range, respectively. The upper and lower limits of a numerical range may be replaced with the upper and lower limits described in Examples below.

Hereinafter, in the case where a composition includes plural substances that correspond to a component of the composition, the content of the component in the composition is the total content of the plural substances in the composition unless otherwise specified.

Hereinafter, the electrostatic image developing toner may be referred to simply as "toner", and the electrostatic image developer may be referred to simply as "developer".

An exemplary embodiment of the disclosure is described below.

Image Forming Apparatus

An image forming apparatus according to the exemplary embodiment includes an image holding member; a latent image forming unit that forms an electrostatic latent image on the image holding member; a developing unit that includes an electrostatic image developer including an electrostatic image developing toner and develops the electrostatic latent image formed on the surface of the image holding member with the electrostatic image developer to form an electrostatic image developing toner image; a transfer unit that transfers the toner image to a recording medium; and a cleaning unit that removes toner particles that remain on the image holding member. The cleaning unit includes a unit A that includes a cleaning blade arranged to contact with the surface of the image holding member. A portion of the cleaning blade which contacts with the image holding member has a JIS-A hardness of 90° or more. In another case, the cleaning unit includes a unit B that includes a cleaning blade arranged to contact with the surface of the image holding member and controls a load with which the cleaning blade contacts with the image holding member in a constant load mode. The electrostatic image developing toner includes toner particles; and silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more.

An image forming apparatus that uses a blade cleaning method is required to achieve a certain scraping ability at the portion of a cleaning blade which contacts with an image holding member (hereinafter, this portion may be referred to as "contacting portion") and certain stability of the attitude of the blade.

Using the unit A or B as a cleaning unit may enhance the scraping ability at the portion of a cleaning blade which contacts with an image holding member and the stability of the attitude of the blade.

However, in the case where an image forming apparatus that includes the unit A or B as a cleaning unit is used for forming images for a long period of time in a high temperature, high humidity environment at a low area coverage with a toner that includes the external additive known in the related art which has a small particle size, the external additive particles may become buried in the toner particles. This reduces the amount of the external additive particles supplied to the contacting portion, increases the coefficient of friction between the image holding member and the cleaning blade, and results in wearing of the cleaning blade, which leads to the degradation of the cleaning performance and the occurrence of image defects, such as formation of white dots in an image.

In the case where an image forming apparatus that includes the unit A or B as a cleaning unit is used for forming images for a long period of time in a low temperature, low humidity environment at a high area coverage with a toner that includes the external additive known in the related art which has a large particle size, the amount of the external additive particles supplied to the contacting portion may be increased. This results in slipping-through of the external additive particles, chipping of the cleaning blade, and occurrence of image defects.

The image forming apparatus according to the exemplary embodiment includes the above-described silica particles having the specific physical properties as external additive particles of an electrostatic image developing toner. This may enable the silica particle to have an adequate degree of rolling action and reduce wearing of a cleaning blade. In addition, the amount of external additive particles that slip through the cleaning unit may be reduced. Consequently, wearing and chipping of a cleaning blade may be reduced. As a result, the occurrence of image defects in the images formed with the image forming apparatus may be reduced.

Details of the structure of the image forming apparatus according to the exemplary embodiment are described below.

The image forming apparatus according to the exemplary embodiment includes an image holding member; a latent image forming unit that forms an electrostatic latent image on the image holding member; a developing unit that develops the electrostatic latent image with a toner to form a toner image; a transfer unit that transfers the toner image to a recording medium; and a cleaning unit that removes toner particles that remain on the image holding member. The cleaning unit includes a unit A that includes a cleaning blade arranged to contact with the surface of the image holding member. A portion of the cleaning blade which contacts with the image holding member has a JIS-A hardness of 90° or more. In another case, the cleaning unit includes a unit B that includes a cleaning blade arranged to contact with the surface of the image holding member and controls a load with which the cleaning blade contacts with the image holding member in a constant load mode.

The image forming apparatus according to the exemplary embodiment may be any image forming apparatus known in the related art, such as a direct-transfer image forming apparatus in which an electrostatic image developing toner image formed on the surface of an image holding member is directly transferred to a recording medium; an intermediate-transfer image forming apparatus in which an electrostatic image developing toner image formed on the surface of an image holding member is transferred onto the surface of an intermediate transfer body in the first transfer step and the electrostatic image developing toner image transferred on the surface of the intermediate transfer body is transferred onto the surface of a recording medium in the second transfer step; and an image forming apparatus including an erasing unit that erases static by irradiating the surface of an image holding member with erasing light subsequent to the transfer of the electrostatic image developing toner image before the image holding member is again charged.

In the case where the image forming apparatus according to the exemplary embodiment is an image forming apparatus using the intermediate transfer system, the transfer unit may be constituted by, for example, an intermediate transfer body to which an electrostatic image developing toner image is transferred, a first transfer subunit that transfers an electrostatic image developing toner image formed on the surface of the image holding member onto the surface of the intermediate transfer body in the first transfer step, and a second transfer subunit that transfers the electrostatic image developing toner image transferred on the surface of the intermediate transfer body onto the surface of a recording medium in the second transfer step.

For example, a portion of the image forming apparatus according to the exemplary embodiment which includes at least the image holding member may be a cartridge structure (i.e., process cartridge) detachably attachable to the image forming apparatus.

An example of the image forming apparatus according to the exemplary embodiment is described below, but the image forming apparatus is not limited thereto. Hereinafter, only components illustrated in drawings are described; others are omitted.

FIG. 1 schematically illustrates an example of the image forming apparatus according to the exemplary embodiment.

The image forming apparatus 10 according to the exemplary embodiment includes, for example, an image holding member (i.e., an electrophotographic photosensitive member) 12 as illustrated in FIG. 1. The image holding member 12 is cylindrical. The image holding member 12 is connected to a driving unit 27, such as a motor, with a driving force transmitting member (not illustrated), such as a gear, and driven to rotate about the rotation axis denoted with the black dot by the driving unit 27. In the example illustrated in FIG. 1, the image holding member 12 is driven to rotate in the direction of the arrow A.

The image holding member 12 is provided with, for example, a charging unit 15, a latent image forming unit 16, a developing unit 18, a transfer unit 31, a cleaning unit 22, and an erasing unit 24 disposed on the periphery of the image holding member 12 in this order in the direction of rotation of the image holding member 12. The image forming apparatus 10 further includes a fixing unit 26, which includes a fusing member 26A and a pressurizing member 26B arranged to contact with the fusing member 26A. The image forming apparatus 10 also includes a controller 36 that controls the action of each unit. Note that, a unit that includes the image holding member 12, the charging unit 15, the latent image forming unit 16, the developing unit 18, the transfer unit 31, and the cleaning unit 22 corresponds to an image forming unit.

In the image forming apparatus 10, at least the image holding member 12 may be combined with other devices to form a process cartridge.

Details of each of the units of the image forming apparatus 10 are described below.

Image Holding Member

The image holding member included in the image forming apparatus according to the exemplary embodiment may include a conductive substrate and a photosensitive layer disposed on the conductive substrate. The image holding member may further include a protection layer disposed on the photosensitive layer.

The photosensitive layer may be a single-layer photosensitive layer that includes a charge generating material and a charge transporting material in the same photosensitive layer and has integrated functions or a multilayer photosensitive layer that includes a charge generation layer and a charge transport layer and has separated functions. In the case where the photosensitive layer is the multilayer photosensitive layer, although the order in which the charge generation layer and the charge transport layer are stacked on each other is not limited, the image holding member may have a structure in which the charge generation layer, the charge transport layer, and the surface protection layer are stacked on and above the conductive substrate in this order. The image holding member may include a layer other than the above layers.

Figure 2:
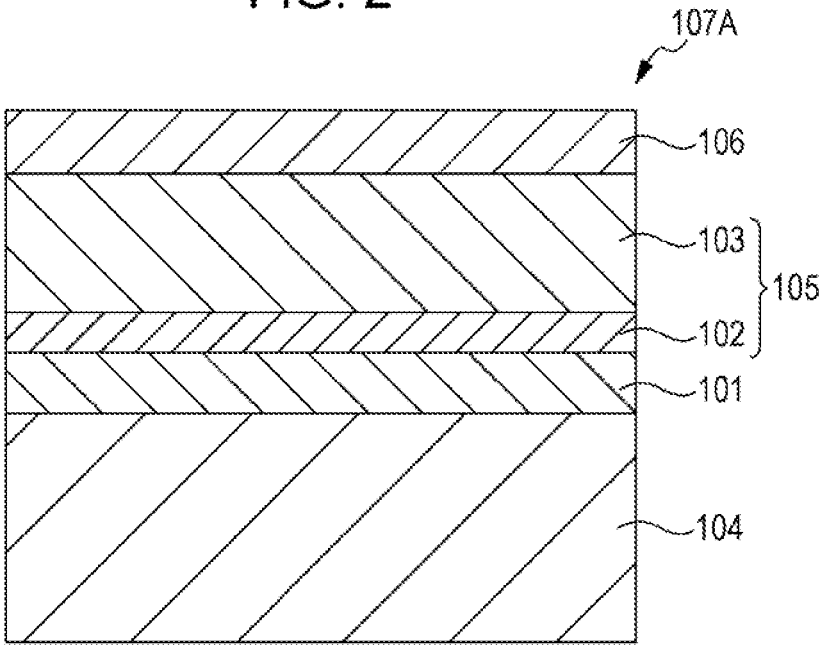
FIG. 2 is a schematic cross-sectional view of an example of the layer structure of an image holding member included in an image forming apparatus according to an exemplary embodiment.

FIG. 2 is a schematic cross-sectional view of an example of the layer structure of the image holding member included in the image forming apparatus according to the exemplary embodiment. The image holding member 107A has a structure in which an undercoat layer 101 is disposed on a conductive substrate 104 and a charge generation layer 102, a charge transport layer 103, and a protection layer 106 are stacked on and above the undercoat layer 101 in this order. In the image holding member 107A, the charge generation layer 102 and the charge transport layer 103 form a photosensitive layer 105 while having separated functions.

Figure 3:
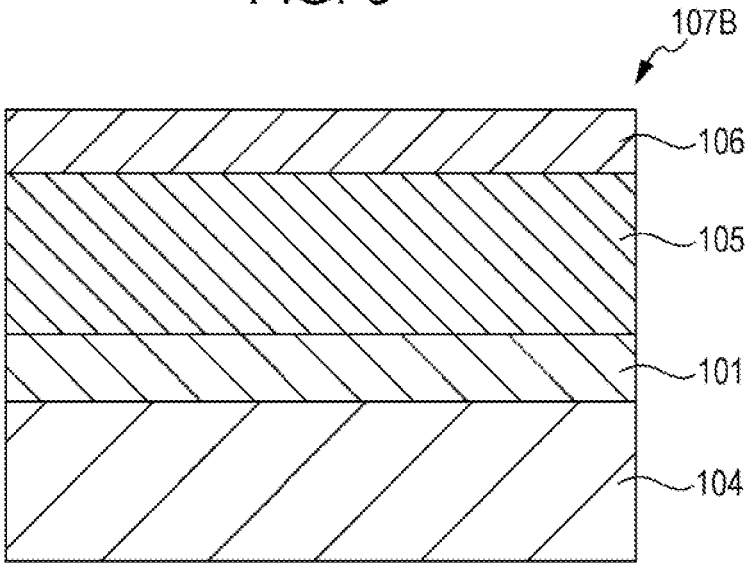
FIG. 3 is a schematic cross-sectional view of another example of the layer structure of an image holding member included in an image forming apparatus according to an exemplary embodiment.

FIG. 3 is a schematic cross-sectional view of another example of the layer structure of the image holding member included in the image forming apparatus according to the exemplary embodiment. The image holding member 107B illustrated in FIG. 3 has a structure in which an undercoat layer 101 is disposed on a conductive substrate 104 and a photosensitive layer 105 and a protection layer 106 are stacked on and above the undercoat layer 101 in this order. In the image holding member 107B, a charge generating material and a charge transporting material are included in the same photosensitive layer, that is, the photosensitive layer 105, which is a single-layer photosensitive layer having integrated functions.

In the exemplary embodiment, the image holding member may, but does not necessarily, include an undercoat layer 101.

Details of the image holding member according to the exemplary embodiment are described below. In the following description, reference numerals are omitted.

Conductive Substrate

Examples of the conductive substrate include a metal sheet, a metal drum, and a metal belt that are made of a metal such as aluminum, copper, zinc, chromium, nickel, molybdenum, vanadium, indium, gold, or platinum or an alloy such as stainless steel. Other examples of the conductive substrate include a paper sheet, a resin film, and a belt on which a conductive compound such as a conductive polymer or indium oxide, a metal such as aluminum, palladium, or gold, or an alloy is deposited by coating, vapor deposition, or lamination. The term "conductive" used herein refers to having a volume resistivity of less than $10^{13}$ Ωcm.

In the case where the image holding member is used as a component of a laser printer, the surface of the conductive substrate may be roughened such that the center-line average roughness Ra of the surface of the conductive substrate is 0.04 μm or more and 0.5 μm or less in order to reduce interference fringes formed when the image holding member is irradiated with a laser beam. On the other hand, it is not necessary to roughen the surface of the conductive substrate in order to reduce the formation of interference fringes in the case where an incoherent light source is used. However, roughening the surface of the conductive substrate may increase the service life of the image holding member by reducing the occurrence of defects caused due to the irregularities formed in the surface of the conductive substrate.

For roughening the surface of the conductive substrate, for example, the following methods may be employed: wet honing in which a suspension prepared by suspending abrasive particles in water is blown onto the surface of the conductive substrate; centerless grinding in which the conductive substrate is continuously ground with rotating grinding wheels brought into pressure contact with the conductive substrate; and an anodic oxidation treatment.

Another example of the roughening method is a method in which, instead of roughening the surface of the conductive substrate, a layer is formed on the surface of the conductive substrate by using a resin including conductive or semiconductive powder particles dispersed therein such that a rough surface is formed due to the particles dispersed in the layer.

In a roughening treatment using anodic oxidation, an oxidation film is formed on the surface of a conductive substrate made of a metal, such as aluminum, by performing anodic oxidation using the conductive substrate as an anode in an electrolyte solution. Examples of the electrolyte solution include a sulfuric acid solution and an oxalic acid solution. A porous anodic oxidation film formed by anodic oxidation is originally chemically active and likely to become contaminated. In addition, the resistance of the porous anodic oxidation film is likely to fluctuate widely with the environment. Accordingly, the porous anodic oxidation film may be subjected to a pore-sealing treatment in which micropores formed in the oxide film are sealed using volume expansion caused by a hydration reaction of the oxidation film in steam under pressure or in boiled water that may include a salt of a metal, such as nickel, so as to be converted into a more stable hydrous oxide film.

The thickness of the anodic oxidation film may be, for example, 0.3 μm or more and 15 μm or less. When the thickness of the anodic oxidation film falls within the above range, the anodic oxidation film may serve as a barrier to injection. Furthermore, an increase in the potential that remains on the image holding member after the repeated use of the image holding member may be limited.

The conductive substrate may be subjected to a treatment in which an acidic treatment liquid is used or a boehmite treatment.

The treatment in which an acidic treatment liquid is used is performed in, for example, the following manner. An acidic treatment liquid that includes phosphoric acid, chromium acid, and hydrofluoric acid is prepared. The proportions of the phosphoric acid, chromium acid, and hydrofluoric acid in the acidic treatment liquid may be, for example, 10% by mass or more and 11% by mass or less, 3% by mass or more and 5% by mass or less, and 0.5% by mass or more and 2% by mass or less, respectively. The total concentration of the above acids may be 13.5% by mass or more and 18% by mass or less. The treatment temperature may be, for example, 42° C. or more and 48° C. or less. The thickness of the resulting coating film may be 0.3 μm or more and 15 μm or less.

In the boehmite treatment, for example, the conductive substrate may be immersed in pure water having a temperature of 90° C. or more and 100° C. or less for 5 to 60 minutes or brought into contact with steam having a temperature of 90° C. or more and 120° C. or less for 5 to 60 minutes. The thickness of the resulting coating film may be 0.1 μm or more and 5 μm or less. The coating film may optionally be subjected to an anodic oxidation treatment with an electrolyte solution in which the coating film is hardly soluble, such as adipic acid, boric acid, a boric acid salt, a phosphoric acid salt, a phthalic acid salt, a maleic acid salt, a benzoic acid salt, a tartaric acid salt, or a citric acid salt.

Undercoat Layer

The undercoat layer includes, for example, inorganic particles and a binder resin.

The inorganic particles may have, for example, a powder resistivity (i.e., volume resistivity) of $10^2$ Ωcm or more and $10^{11}$ Ωcm or less. Among such inorganic particles having the above resistivity, for example, metal oxide particles such as tin oxide particles, titanium oxide particles, zinc oxide particles, and zirconium oxide particles are preferable and zinc oxide particles are particularly preferable.

The BET specific surface area of the inorganic particles may be, for example, 10 $m^2/g$ or more.

The volume average diameter of the inorganic particles is preferably, for example, 50 nm or more and 2,000 nm or less and is more preferably 60 nm or more and 1,000 nm or less.

The content of the inorganic particles is preferably, for example, 10% by mass or more and 80% by mass or less and is more preferably 40% by mass or more and 80% by mass or less of the amount of binder resin.

The inorganic particles may optionally be subjected to a surface treatment. It is possible to use two or more types of inorganic particles which have been subjected to different surface treatments or have different diameters in a mixture.

Examples of an agent used in the surface treatment include a silane coupling agent, a titanate coupling agent, an aluminum coupling agent, and a surfactant. In particular, a silane coupling agent is preferable, and a silane coupling agent including an amino group is more preferable.

Examples of the silane coupling agent including an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in a mixture. For example, a silane coupling agent including an amino group may be used in combination with another type of silane coupling agent. Examples of the other type of silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

A method for treating the surface of the inorganic particles with the surface-treating agent is not limited, and any known surface treatment method may be employed. Both dry process and wet process may be employed.

The amount of surface-treating agent used may be, for example, 0.5% by mass or more and 10% by mass or less of the amount of inorganic particles.

The undercoat layer may include an electron accepting compound (i.e., an acceptor compound) in addition to the inorganic particles in order to enhance the long-term stability of electrical properties and carrier-blocking property.

Examples of the electron accepting compound include the following electron transporting substances: quinones, such as chloranil and bromanil; tetracyanoquinodimethanes; fluorenones, such as 2,4,7-trinitrofluorenone and 2,4,5,7-tetranitro-9-fluorenone; oxadiazoles, such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthones; thiophenes; and diphenoquinones, such as 3,3',5,5'-tetra-t-butyldiphenoquinone.

In particular, compounds including an anthraquinone structure may be used as an electron accepting compound.

Examples of the compounds including an anthraquinone structure include hydroxyanthraquinones, aminoanthraquinones, and aminohydroxyanthraquinones. Specific examples thereof include anthraquinone, alizarin, quinizarin, anthrarufin, and purpurin.

The electron accepting compound may be dispersed in the undercoat layer together with the inorganic particles or deposited on the surfaces of the inorganic particles.

For depositing the electron accepting compound on the surfaces of the inorganic particles, for example, a dry process or a wet process may be employed.

In a dry process, for example, while the inorganic particles are stirred with a mixer or the like capable of producing a large shearing force, the electron accepting compound or a solution prepared by dissolving the electron accepting compound in an organic solvent is added dropwise or sprayed together with dry air or a nitrogen gas to the inorganic particles in order to deposit the electron accepting compound on the surfaces of the inorganic particles. The addition or spraying of the electron accepting compound may be done at a temperature equal to or lower than the boiling point of the solvent used.

Subsequent to the addition or spraying of the electron accepting compound, the resulting inorganic particles may optionally be burnt at 100° C. or more. The temperature at which the inorganic particles are burnt and the amount of time during which the inorganic particles are burnt are not limited; the inorganic particles may be burnt under appropriate conditions of temperature and time under which the intended electrophotographic properties are achieved.

In a wet process, for example, while the inorganic particles are dispersed in a solvent with a stirrer, an ultrasonic wave, a sand mill, an Attritor, a ball mill, or the like, the electron accepting compound is added to the dispersion liquid. After the resulting mixture has been stirred or dispersed, the solvent is removed such that the electron accepting compound is deposited on the surfaces of the inorganic particles. The removal of the solvent may be done by, for example, filtration or distillation. Subsequent to the removal of the solvent, the resulting inorganic particles may optionally be burnt at 100° C. or more. The temperature at which the inorganic particles are burnt and the amount of time during which the inorganic particles are burnt are not limited; the inorganic particles may be burnt under appropriate conditions of temperature and time under which the intended electrophotographic properties are achieved. In the wet process, moisture contained in the inorganic particles may be removed prior to the addition of the electron accepting compound. The removal of moisture contained in the inorganic particles may be done by, for example, heating the inorganic particles while being stirred in the solvent or by bringing the moisture to the boil together with the solvent.

The deposition of the electron accepting compound may be done prior or subsequent to the surface treatment of the inorganic particles with the surface-treating agent. Alternatively, the deposition of the electron accepting compound and the surface treatment using the surface-treating agent may be performed at the same time.

The content of the electron accepting compound is preferably 0.01% by mass or more and 20% by mass or less and is more preferably 0.01% by mass or more and 10% by mass or less of the total amount of the inorganic particles.

Examples of the binder resin included in the undercoat layer include the following known materials: known high-molecular compounds such as an acetal resin (e.g., polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenolic resin, a phenol-formaldehyde resin, a melamine resin, a urethane resin, an alkyd resin, and an epoxy resin; zirconium chelates; titanium chelates; aluminum chelates; titanium alkoxides; organotitanium compounds; and silane coupling agents.

Other examples of the binder resin included in the undercoat layer include charge transporting resins including a charge transporting group and conductive resins such as polyaniline. Among the above binder resins, a resin insoluble in a solvent included in a coating liquid used for forming a layer on the undercoat layer may be used as a binder resin included in the undercoat layer. In particular, resins produced by reacting at least one resin selected from the group consisting of thermosetting resins (e.g., a urea resin, a phenolic resin, a phenol-formaldehyde resin, a melamine resin, a urethane resin, an unsaturated polyester resin, an alkyd resin, and an epoxy resin), polyamide resins, polyester resins, polyether resins, methacrylic resins, acrylic resins, polyvinyl alcohol resins, and polyvinyl acetal resins with a curing agent may be used.

In the case where two or more types of the above binder resins are used in combination, the mixing ratio may be set appropriately.

The undercoat layer may include various additives in order to enhance electrical properties, environmental stability, and image quality.

Examples of the additives include the following known materials: electron transporting pigments such as polycondensed pigments and azo pigments, zirconium chelates, titanium chelates, aluminum chelates, titanium alkoxides, organotitanium compounds, and silane coupling agents. The silane coupling agents, which are used in the surface treatment of the inorganic particles as described above, may also be added to the undercoat layer as an additive.

Examples of silane coupling agents that may be used as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelates include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelates include tetraisopropyl titanate, tetra-n-butyl titanate, butyl titanate dimer, tetra-(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelates include aluminum isopropylate, monobutoxy aluminum diisopropylate, aluminum butyrate, diethyl acetoacetate aluminum diisopropylate, and aluminum tris(ethyl acetoacetate).

The above additives may be used alone. Alternatively, two or more types of the above additives may be used in a mixture or in the form of a polycondensate.

The undercoat layer may have a Vickers hardness of 35 or more.

In order to reduce the formation of moiré fringes, the surface roughness (i.e., ten-point average roughness) of the undercoat layer may be adjusted to 1/(4n) to ½ of the wavelength λ of the laser beam used as exposure light, where n is the refractive index of the layer that is to be formed on the undercoat layer.

Resin particles and the like may be added to the undercoat layer in order to adjust the surface roughness of the undercoat layer. Examples of the resin particles include silicone resin particles and crosslinked polymethyl methacrylate resin particles. The surface of the undercoat layer may be ground in order to adjust the surface roughness of the undercoat layer. For grinding the surface of the undercoat layer, buffing, sand blasting, wet honing, grinding, and the like may be performed.

The method for forming the undercoat layer is not limited, and known methods may be employed. The undercoat layer may be formed by, for example, forming a coating film using a coating liquid prepared by mixing the above-described components with a solvent (hereinafter, this coating liquid is referred to as "undercoat layer forming coating liquid"), drying the coating film, and, as needed, heating the coating film.

Examples of the solvent used for preparing the undercoat layer forming coating liquid include known organic solvents, such as an alcohol solvent, an aromatic hydrocarbon solvent, a halogenated hydrocarbon solvent, a ketone solvent, a ketone alcohol solvent, an ether solvent, and an ester solvent.

Specific examples thereof include the following common organic solvents: methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

For dispersing the inorganic particles in the preparation of the undercoat layer forming coating liquid, for example, known equipment such as a roll mill, a ball mill, a vibrating ball mill, an Attritor, a sand mill, a colloid mill, and a paint shaker may be used.

For coating the conductive substrate with the undercoat layer forming coating liquid, for example, common methods such as blade coating, wire bar coating, spray coating, dip coating, bead coating, air knife coating, and curtain coating may be employed.

The thickness of the undercoat layer is preferably, for example, 15 μm or more and is more preferably 20 μm or more and 50 μm or less.

Intermediate Layer

Although not illustrated in the drawings, an intermediate layer may optionally be interposed between the undercoat layer and the photosensitive layer.

The intermediate layer includes, for example, a resin. Examples of the resin included in the intermediate layer include the following high-molecular compounds: acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may include an organometallic compound. Examples of the organometallic compound included in the intermediate layer include organometallic compounds containing a metal atom such as a zirconium atom, a titanium atom, an aluminum atom, a manganese atom, or a silicon atom.

The above compounds included in the intermediate layer may be used alone. Alternatively, two or more types of the above compounds may be used in a mixture or in the form of a polycondensate.

In particular, the intermediate layer may include an organometallic compound containing a zirconium atom or a silicon atom.

The method for forming the intermediate layer is not limited, and known methods may be employed. The intermediate layer may be formed by, for example, forming a coating film using an intermediate layer forming coating liquid prepared by mixing the above-described components with a solvent, drying the coating film, and, as needed, heating the coating film.

For forming the intermediate layer, common coating methods such as dip coating, push coating, wire bar coating, spray coating, blade coating, knife coating, and curtain coating may be employed.

The thickness of the intermediate layer may be, for example, 0.1 μm or more and 3 μm or less. It is possible to use the intermediate layer also as an undercoat layer.

Charge Generation Layer

The charge generation layer is, for example, a layer that includes a charge generating material and a binder resin. The charge generation layer may be a layer formed by vapor deposition of a charge generating material. The vapor deposition layer of a charge generating material may be used in the case where an incoherent light source, such as a light emitting diode (LED) or an organic electro-luminescence (EL) image array, is used.

Examples of the charge generating material include azo pigments, such as bisazo and trisazo; condensed aromatic pigments, such as dibromoanthanthrone; perylene pigments; pyrrolopyrrole pigments; phthalocyanine pigments; zinc oxide; and trigonal selenium.

Among the above charge generating materials, in particular, a metal phthalocyanine pigment or a nonmetal phthalocyanine pigment may be used in consideration of exposure to a laser beam in the near-infrared region. Specific examples of such charge generating materials include hydroxygallium phthalocyanine disclosed in, for example, Japanese Laid Open Patent Application Publication Nos. H5-263007 and H5-279591, chlorogallium phthalocyanine disclosed in, for example, Japanese Laid Open Patent Application Publication No. H5-98181, dichloro tin phthalocyanine disclosed in, for example, Japanese Laid Open Patent Application Publication Nos. H5-140472 and H5-140473, and titanyl phthalocyanine disclosed in, for example, Japanese Laid Open Patent Application Publication No. H4-189873.

Among the above charge generating materials, condensed aromatic pigments such as dibromoanthanthrone; thioindigo pigments; porphyrazines; zinc oxide; trigonal selenium; and the bisazo pigments disclosed in Japanese Laid Open Patent Application Publication Nos. 2004-78147 and 2005-181992 may be used in consideration of exposure to a laser beam in the near-ultraviolet region.

The above charge generating materials may be used also in the case where an incoherent light source such as an LED or an organic EL image array, which emits light having a center wavelength of 450 nm or more and 780 nm or less, is used. However, when the thickness of the photosensitive layer is reduced to 20 μm or less in order to increase the resolution, the strength of the electric field in the photosensitive layer may be increased. This increases the occurrence of a reduction in the amount of charge generated due to the injection of charge from the substrate, that is, image defects referred to as "black spots". This becomes more pronounced when a p-type semiconductor that is likely to induce a dark current, such as trigonal selenium or a phthalocyanine pigment, is used as a charge generating material.

In contrast, in the case where an n-type semiconductor such as a condensed aromatic pigment, a perylene pigment, or an azo pigment is used as a charge generating material, the dark current is hardly induced and the occurrence of the image defects referred to as "black spots", may be reduced even when the thickness of the photosensitive layer is reduced. Examples of an n-type charge generating material include, but are not limited to, the compounds (CG-1) to (CG-27) described in Paragraphs [0288] to [0291] of Japanese Laid Open Patent Application Publication No. 2012-155282.

Whether or not a charge generating material is n-type is determined on the basis of the polarity of the photoelectric current that flows in the charge generating material by a commonly used time-of-flight method. Specifically, a charge generating material in which electrons are more easily transmitted as carriers than holes is determined to be n-type.

The binder resin included in the charge generation layer is selected from various insulating resins. The binder resin may also be selected from organic photoconductive polymers such as poly-N-vinylcarbazole, polyvinyl anthracene, polyvinylpyrene, and polysilane.

Specific examples of the binder resin include a polyvinyl butyral resin, a polyarylate resin (e.g., polycondensate of a bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. The term "insulating" used herein refers to having a volume resistivity of $10^{13}$ Ωcm or more.

The above binder resins may be used alone or in a mixture of two or more.

The ratio of the amount of charge generating material to the amount of binder resin may be 10:1 to 1:10 by mass.

The charge generation layer may optionally include the additives known in the related art.

The method for forming the charge generation layer is not limited. Any known method may be employed. The charge generation layer may be formed by, for example, forming a coating film using a coating liquid prepared by mixing the above-described components with a solvent (hereinafter, this coating liquid is referred to as "charge generation layer forming coating liquid"), drying the coating film, and, as needed, heating the coating film. Alternatively, the charge generation layer may be formed by the vapor deposition of the charge generating material. The charge generation layer may be formed by the vapor deposition particularly when the charge generating material is a condensed aromatic pigment or a perylene pigment.

Examples of the solvent used for preparing the charge generation layer forming coating liquid include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. The above solvents may be used alone or in a mixture of two or more.

For dispersing particles of the charge generating material or the like in the charge generation layer forming coating liquid, for example, media dispersing machines, such as a ball mill, a vibrating ball mill, an Attritor, a sand mill, and a horizontal sand mill; and medialess dispersing machines, such as a stirrer, an ultrasonic wave disperser, a roll mill, and a high-pressure homogenizer, may be used. Specific examples of the high-pressure homogenizer include an impact-type homogenizer in which a dispersion liquid is brought into collision with a liquid or a wall under a high pressure in order to perform dispersion and a through-type homogenizer in which a dispersion liquid is passed through a very thin channel under a high pressure in order to perform dispersion.

The average diameter of the particles of the charge generating material dispersed in the charge generation layer forming coating liquid is preferably 0.5 μm or less, is more preferably 0.3 μm or less, and is further preferably 0.15 μm or less.

For applying the charge generation layer forming coating liquid to the undercoat layer (or, the intermediate layer), for example, common coating methods such as blade coating, wire bar coating, spray coating, dip coating, bead coating, air knife coating, and curtain coating may be employed.

The thickness of the charge generation layer is, for example, preferably 0.1 μm or more and 5.0 μm or less and is more preferably 0.2 μm or more and 2.0 μm or less.

Charge Transport Layer

The charge transport layer includes, for example, a charge transporting material and a binder resin. The charge transport layer may be a layer including a high-molecular charge transporting material.

Examples of the charge transporting material include, but are not limited to, the following electron transporting compounds: quinones, such as p-benzoquinone, chloranil, bromanil, and anthraquinone; tetracyanoquinodimethane compounds; fluorenones, such as 2,4,7-trinitrofluorenone; xanthones; benzophenones; cyanovinyl compounds; and ethylenes. Examples of the charge transporting material further include hole transporting compounds such as triarylamines, benzidines, arylalkanes, aryl-substituted ethylenes, stilbenes, anthracenes, and hydrazones. The above charge transporting materials may be used alone or in combination of two or more.

In particular, the triarylamine derivative represented by Structural Formula (a-1) below or the benzidine derivative represented by Structural Formula (a-2) below may be used as a charge transporting material in consideration of the mobility of charge.

(a-1)

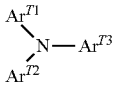

In Structural Formula (a-1), $Ar^{T1}$, $Ar^{T2}$, and $Ar^{T3}$ each independently represent an aryl group, a substituted aryl group, a $—C_6H_4—C(R^{T4})═C(R^{T5})(R^{T6})$ group, or a $—C_6H_4—CH═CH—CH═C(R^{T7})(R^{T8})$ group, where $R^{T4}$, $R^{T5}$, $R^{T6}$, $R^{T7}$, and $R^{T8}$ each independently represent a hydrogen atom, an alkyl group, a substituted alkyl group, an aryl group, or a substituted aryl group.

Examples of a substituent included in the above substituted groups include a halogen atom, an alkyl group having 1 to 5 carbon atoms, an alkoxy group having 1 to 5 carbon atoms, and an amino group substituted with an alkyl group having 1 to 3 carbon atoms.

(a-2)

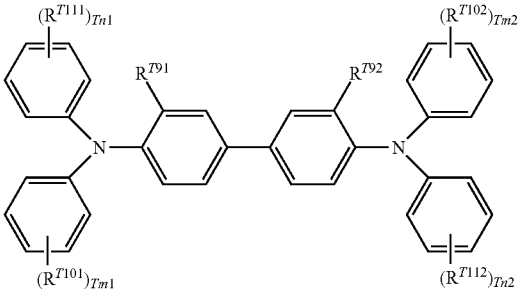

In Structural Formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, an aryl group, a substituted aryl group, a $—C(R^{T12})═C(R^{T13})(R^{T14})$ group, or a $—CH═CH—CH═C(R^{T15})(R^{T16})$ group, where $R^{T12}$, $R^{T13}$, $R^{T14}$, $R^{T15}$, and $R^{T16}$ each independently represent a hydrogen atom, an alkyl group, a substituted alkyl group, an aryl group, or a substituted aryl group; and Tm1, Tm2, Tn1, and Tn2 each independently represent an integer of 0 to 2.

Examples of a substituent included in the above substituted groups include a halogen atom, an alkyl group having 1 to 5 carbon atoms, an alkoxy group having 1 to 5 carbon atoms, and an amino group substituted with an alkyl group having 1 to 3 carbon atoms.

Among triarylamine derivatives represented by Structural Formula (a-1) above and benzidine derivatives represented by Structural Formula (a-2) above, in particular, a triarylamine derivative that includes the $—C_6H_4—CH═CH—CH═C(R^{T7})(R^{T8})$ group or a benzidine derivative that includes the $—CH═CH—CH═C(R^{T15})(R^{T16})$ group may be used in consideration of the mobility of charge.

The high-molecular charge transporting material may be any known charge transporting material, such as poly-N-vinylcarbazole or polysilane. In particular, the polyester high-molecular charge transporting materials disclosed in Japanese Laid Open Patent Application Publication Nos. H8-176293 and H8-208820 may be used. The above high-molecular charge transporting materials may be used alone or in combination with the above binder resins.

Examples of the binder resin included in the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among the above binder resins, in particular, a polycarbonate resin and a polyarylate resin may be used. The above binder resins may be used alone or in combination of two or more.

The ratio of the amounts of the charge transporting material and the binder resin included in the charge transport layer may be 10:1 to 1:5 by mass.

The charge transport layer may optionally include known additives.

The method for forming the charge transport layer is not limited, and any known method may be employed. The charge transport layer may be formed by, for example, forming a coating film using a coating liquid prepared by mixing the above-described components with a solvent (hereinafter, this coating liquid is referred to as "charge transport layer forming coating liquid"), drying the coating film, and, as needed, heating the coating film.

Examples of the solvent used for preparing the charge transport layer forming coating liquid include the following common organic solvents: aromatic hydrocarbons, such as benzene, toluene, xylene, and chlorobenzene; ketones, such as acetone and 2-butanone; halogenated aliphatic hydrocarbons, such as methylene chloride, chloroform, and ethylene chloride; and cyclic and linear ethers, such as tetrahydrofuran and ethyl ether. The above solvents may be used alone or in a mixture of two or more.

For applying the charge transport layer forming coating liquid onto the surface of the charge generation layer, for example, the following common coating methods may be used: blade coating, wire bar coating, spray coating, dip coating, bead coating, air knife coating, and curtain coating.

The thickness of the charge transport layer is, for example, preferably 5 μm or more and 50 μm or less and is more preferably 10 μm or more and 30 μm or less.

Protection Layer

A surface protection layer (hereinafter, may be referred to simply as "protection layer") may be disposed on the photosensitive layer. The protection layer is provided in order to, for example, reduce the chemical change of the photosensitive layer which may occur during charging and increase the mechanical strength of the photosensitive layer. Therefore, the protection layer may be a layer composed of a cured film (i.e., a crosslinked film). Examples of such a layer include the layers described in 1) and 2) below.

1) A layer composed of a film formed by curing a composition including a reactive group-containing charge transporting material that includes a reactive group and a charge transporting skeleton in the same molecule, that is, a layer including a polymer or a crosslinked product of the reactive group-containing charge transporting material.

2) A layer composed of a film formed by curing a composition including a nonreactive charge transporting material and a reactive group-containing non-charge transporting material that does not include a charge transporting skeleton and includes a reactive group, that is, a layer including a polymer or a crosslinked product of the nonreactive charge transporting material with the reactive group-containing non-charge transporting material.

Examples of the reactive group include the following known reactive groups: a chain-polymerization group; an epoxy group; a —OH group; a —OR group, where R is an alkyl group; a $—NH_2$ group; a —SH group; a —COOH group; and a $—SiR^{Q1}_{3-Qn}(OR^{Q2})_{Qn}$ group, where $R^{Q1}$ represents a hydrogen atom, an alkyl group, an aryl group, or a substituted aryl group, $R^{Q2}$ represents a hydrogen atom, an alkyl group, or a trialkylsilyl group, and Qn is an integer of 1 to 3. Examples of the reactive group included in the reactive group-containing non-charge transporting material include the known reactive groups described above.

The chain-polymerization group is not limited, and may be any functional group capable of inducing radical polymerization. Examples of the chain-polymerization group include functional groups including an ethylenically unsaturated bond. Specific examples of the functional groups including an ethylenically unsaturated bond include functional groups including at least one selected from the group consisting of a vinyl group, a vinyl ether group, a vinylthioether group, a styryl (vinylphenyl) group, an acryloyl group, a methacryloyl group, and derivatives of the above groups. In particular, a chain-polymerization group including at least one selected from the group consisting of a vinyl group, a styryl (vinylphenyl) group, an acryloyl group, a methacryloyl group, and derivatives of the above groups is preferably used, a chain-polymerization group including at least one selected from the group consisting of an acryloyl group, a methacryloyl group, and derivatives of the above groups is more preferably used, and a chain-polymerization group including at least one of an acryloyl group and a methacryloyl group is further preferably used, because such a chain-polymerization group has high reactivity.

The charge transporting skeleton is not limited and may be any charge transporting skeleton having a structure known in the field of image holding members. Examples of such a charge transporting skeleton include skeletons that are derived from nitrogen-containing hole transporting compounds, such as triarylamines (compounds having a triarylamine skeleton), benzidines (compounds having a benzidine skeleton), and hydrazones (compounds having a hydrazone skeleton), and conjugated with a nitrogen atom. Among the above skeletons, a triarylamine skeleton may be included as a charge transporting skeleton.

The above reactive group-containing charge transporting material, the nonreactive charge transporting material, and the reactive group-containing non-charge transporting material may be selected from known materials.

Among the layers described in 1) and 2) above, the layer 1) composed of a film formed by curing a composition including a reactive group-containing charge transporting material that includes a reactive group and a charge transporting skeleton in the same molecule may be used as a protection layer. In the case where the protection layer is the layer 1) composed of a film formed by curing a composition including a reactive group-containing charge transporting material that includes a reactive group and a charge transporting skeleton in the same molecule, the protection layer may have a higher hardness than the protection layer composed of the cured product formed as described in 2) above.

The reactive group-containing charge transporting material may include a reactive group-containing charge transporting material that includes at least one of an acryloyl group and a methacryloyl group as a reactive group (hereinafter, this reactive group-containing charge transporting material is referred to as "specific reactive group-containing charge transporting material (a)").

Specific Reactive Group-Containing Charge Transporting Material (a)

The specific reactive group-containing charge transporting material (a) included in the protection layer is a compound that includes a charge transporting skeleton and an acryloyl or methacryloyl group in the same molecule. The specific reactive group-containing charge transporting material (a) is not limited and may be any compound that satisfies the above structural conditions.

The specific reactive group-containing charge transporting material (a) may be a compound that includes a methacryloyl group. The reason is not clear but considered as follows. Compounds that include an acryloyl group, which has high reactivity, are commonly used for a curing reaction. In the case where a bulky charge transporting skeleton includes an acryloyl group, which has high reactivity, as a substituent, inconsistencies are likely to occur in a curing reaction and, consequently, inconsistencies and wrinkles are likely to be formed in the protection layer. It is considered that using a specific reactive group-containing charge transporting material (a) including a methacryloyl group, which is less reactive than an acryloyl group, may reduce the formation of inconsistencies and wrinkles in the protection layer.

In the specific reactive group-containing charge transporting material (a), one or more carbon atoms may be interposed between the charge transporting skeleton and the acryloyl or methacryloyl group. That is, the specific reactive group-containing charge transporting material (a) may include a carbon chain that includes one or more carbon atoms as a linking group interposed between the charge transporting skeleton and the acryloyl or methacryloyl group. In particular, the linking group may be an alkylene group.

The reason is not clear but considered as follows. For example, as for the mechanical strength of the protection layer, if the bulky charge transporting skeleton and the polymerizing part (i.e., the acryloyl or methacryloyl group) are close to each other and rigid, the mobility of the polymerizing parts may be reduced and, consequently, the chances of reaction may be reduced.

The specific reactive group-containing charge transporting material (a) may be a compound (a') that includes a triphenylamine skeleton and three or more (more preferably, four or more) methacryloyl groups in the same molecule. In such a case, the stability of the compound during the synthesis may be enhanced. Moreover, a protection layer having a high crosslinking density and a sufficiently high mechanical strength may be formed. This makes it easy to increase the thickness of the protection layer.

In the exemplary embodiment, the specific reactive group-containing charge transporting material (a) may be the compound represented by General Formula (A) below in order to enhance charge transportability.

(A)

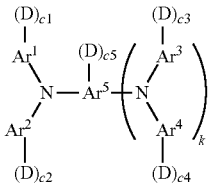

In General Formula (A), $Ar^1$ to $Ar^4$ each independently represent a substituted or unsubstituted aryl group; $Ar^5$ represents a substituted or unsubstituted aryl group or a substituted or unsubstituted arylene group; D represents $—(CH_2)_d—(O—CH_2—CH_2)_e—O—CO—C(CH_3)=CH_2$; c1 to c5 each independently represent an integer of 0 to 2; k represents 0 or 1; d represents an integer of 0 to 5; e represents 0 or 1; and the total number of the groups D is 4 or more.

In General Formula (A), $Ar^1$ to $Ar^4$ each independently represent a substituted or unsubstituted aryl group. $Ar^1$ to $Ar^4$ may be identical to or different from one another.

Examples of the substituent included in the substituted aryl group which are other than D: $—(CH_2)_d—(O—CH_2—CH_2)_e—O—CO—C(CH_3)=CH_2$ include an alkyl or alkoxy group having 1 to 4 carbon atoms and a substituted or unsubstituted aryl group having 6 to 10 carbon atoms.

$Ar^1$ to $Ar^4$ may be any of the groups represented by Formulae (1) to (7) below. In Formulae (1) to (7) below, "$-(D)_{c1}$" to "$-(D)_{c4}$" attached to $Ar^1$ to $Ar^4$, respectively, are denoted collectively as "$-(D)_c$".

(1)

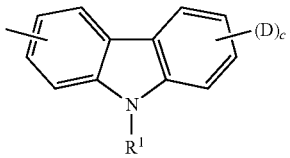

(2)

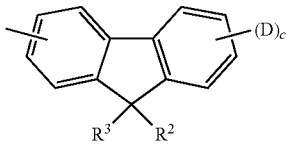

(3)

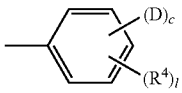

(4)

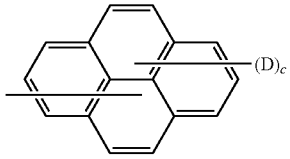

(5)

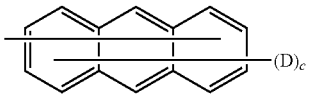

-continued (6)

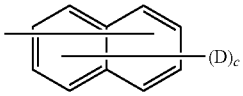

(7)

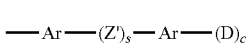

In Formulae (1) to (7), $R^1$ represents a group selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; $R^2$ to $R^4$ each independently represent a group selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; D represents $—(CH_2)_d—(O—CH_2—CH_2)_e—O—CO—C(CH_3)=CH_2$; c represents 1 or 2; s represents 0 or 1; and t represents an integer of 0 to 3.

In Formula (7), Ar may be the group represented by Structural Formula (8) or (9) below.

(8)

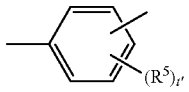

(9)

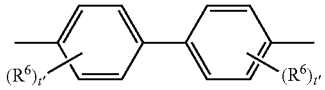

In Formulae (8) and (9), $R^5$ and $R^6$ each independently represent a group selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and t' represents an integer of 0 to 3.

In Formula (7), Z' represents a divalent organic linking group. The divalent organic linking group may be any of the groups represented by Formulae (10) to (17) below. In Formula (7), s represents 0 or 1.

(10)

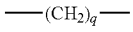

(11)

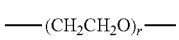

(12)

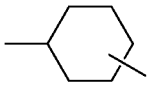

(13)

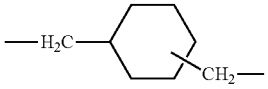

-continued (14)

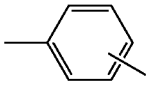

(15)

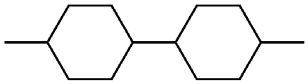

(16)

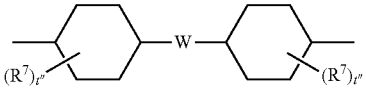

(17)

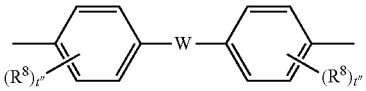

In Formulae (10) to (17), $R^7$ and $R^8$ each independently represent a group selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; W represents a divalent group; q and r each independently represent an integer of 1 to 10; and t" each independently represents an integer of 0 to 3.

In Formulae (16) and (17), W may be any of the divalent groups represented by Formulae (18) to (26) below. In Formula (25), u represents an integer of 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

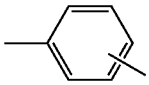

(25)

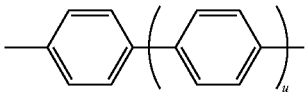

(26)

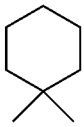

In General Formula (A), when k=0, $Ar^5$ is a substituted or unsubstituted aryl group. Examples of the aryl group include the aryl group described in the description of $Ar^1$ to $Ar^4$ above as an example. When k=1, $Ar^5$ is a substituted or unsubstituted arylene group. Examples of the arylene group include an arylene group produced by removing one hydrogen atom from the aryl group described in the description of $Ar^1$ to $Ar^4$ above as an example which is attached to the position to which $-N(Ar^3\text{-}(D)_{c3})(Ar^4\text{-}(D)_{c4})$ is to be attached.

Specific examples of the compound represented by General Formula (A) include the compounds described in Paragraphs [0236] to [0240] of Japanese Laid Open Patent Application Publication No. 2018-4968.

Examples of the method for producing the compound represented by General Formula (A) include the production method described in Paragraphs [0241] to [0244] of Japanese Laid Open Patent Application Publication No. 2018-4968.

The reactive charge transporting material may further include a compound other than the specific reactive group-containing charge transporting material (a) (hereinafter, this compound is referred to as "another reactive charge transporting material (a")"). The other reactive charge transporting material is a compound produced by introducing an acryloyl or methacryloyl group into the charge transporting material known in the related art.

The proportion of the specific reactive group-containing charge transporting material (a) to the reactive group-containing charge transporting material is preferably 90% by mass or more and 100% by mass or less and is more preferably 98% by mass or more and 100% by mass or less.

The content of the reactive group-containing charge transporting material is preferably 30% by mass or more and 100% by mass or less, is more preferably 40% by mass or more and 100% by mass or less, and is further preferably 50% by mass or more and 100% by mass or less of the solid content of the composition used for forming the protection layer. When the content of the reactive group-containing charge transporting material falls within the above range, the cured film has suitable electric properties and the thickness of the cured film may be increased.

The universal hardness of the protection layer is preferably 140 $N/mm^2$ or more and 300 $N/mm^2$ or less, is more preferably 160 $N/mm^2$ or more and 280 $N/mm^2$ or less, and is further preferably 180 $N/mm^2$ or more and 260 $N/mm^2$ or less.

The universal hardness of the protection layer is measured by the following method.

A hardness test is conducted using a Vickers quadrangular pyramidal diamond indenter at 25° C. and a relative humidity of 50%. The universal hardness measured when the indenter is pressed against the protection layer at a maximum load of 20 mN is considered as the universal hardness of the protection layer.

Details of Measurement

In the measurement, a micro hardness tester "FISCHERSCOPE H100V" produced by Fischer Instruments K.K. is used. The indenter used in the measurement is a Vickers quadrangular pyramidal diamond indenter having a face angle of 136°.

Measurement Conditions loading conditions: a Vickers indenter is pressed against the surface of the protection layer of the image holding member at a rate of 4 mN/sec.

loading time: 5 sec holding time: 5 sec unloading conditions: unloading is done at the same rate as in loading.

In the measurement, the image holding member is fixed to the H100V tester and the Vickers indenter is pressed against the surface of the protection layer in a direction perpendicular to the surface of the protection layer. In the measurement, loading with an indenter (5 sec), holding the load (5 sec), and unloading are done in this order.

The protection layer may optionally include known additives.

The method for forming the protection layer is not limited, and known methods may be used. The protection layer may be formed by, for example, forming a coating film using a coating liquid prepared by mixing the above-described components in a solvent (hereinafter, this coating liquid is referred to as "protection layer forming coating liquid"), drying the coating film, and, as needed, curing the coating film by heating or the like.

Examples of the solvent used for preparing the protection layer forming coating liquid include aromatic solvents, such as toluene and xylene; ketone solvents, such as methyl ethyl ketone, methyl isobutyl ketone, and cyclohexanone; ester solvents, such as ethyl acetate and butyl acetate; ether solvents, such as tetrahydrofuran and dioxane; cellosolve solvents, such as ethylene glycol monomethyl ether; and alcohol solvents, such as isopropyl alcohol and butanol. The above solvents may be used alone or in a mixture of two or more. The protection layer forming coating liquid may be prepared without using a solvent.

For applying the protection layer forming coating liquid on the photosensitive layer (e.g., the charge transport layer), for example, the following common methods may be used: dip coating, push coating, wire bar coating, spray coating, blade coating, knife coating, and curtain coating.

The thickness of the protection layer is preferably, for example, 1 μm or more and 20 μm or less and is more preferably 2 μm or more and 10 μm or less.

Single-Layer Photosensitive Layer

A single-layer photosensitive layer (i.e., charge generation and transport layer) includes, for example, a charge generating material, a charge transporting material, and, as needed, a binder resin and known additives. These materials are the same as those described in Charge Generation Layer and Charge Transport Layer above.

The content of the charge generating material in the single-layer photosensitive layer is preferably 0.1% by mass or more and 10% by mass or less and is more preferably 0.8% by mass or more and 5% by mass or less of the total solid content of the single-layer photosensitive layer. The content of the charge transporting material in the single-layer photosensitive layer may be 5% by mass or more and 50% by mass or less of the total solid content of the single-layer photosensitive layer.

The single-layer photosensitive layer may be formed by the same method as in the formation of the charge generation layer and the charge transport layer.

The thickness of the single-layer photosensitive layer is, for example, preferably 5 μm or more and 50 μm or less and is more preferably 10 μm or more and 40 μm or less.

Charging Unit

The image forming apparatus according to the exemplary embodiment may include a charging unit that charges the surface of the image holding member.

The charging unit 15 charges the surface of the image holding member 12. For example, the charging unit 15 is arranged to contact or not to contact with the surface of the image holding member 12. The charging unit 15 includes, for example, a charging member 14 that charges the surface of the image holding member 12 and a power source 28 (an example of voltage application portion for the charging member) that applies a charging voltage to the charging member 14. The power source 28 is electrically connected to the charging member 14.

Examples of the charging member 14 included in the charging unit 15 include contact chargers that include a charging roller, a charging brush, a charging film, a charging rubber blade, or a charging tube that are electrically conductive. Examples of the charging member 14 also include contactless roller chargers and known chargers, such as a scorotron charger and a corotron charger that use corona discharge.

Latent Image Forming Unit

The latent image forming unit 16 forms an electrostatic latent image on the charged surface of the image holding member 12. Specifically, for example, the latent image forming unit 16 irradiates the surface of the image holding member 12, which has been charged by the charging member 14, with light L modulated on the basis of the information of the image that is to be formed and thereby forms an electrostatic latent image corresponding to the image of the image information on the image holding member 12.

Examples of the latent image forming unit 16 include optical devices that includes a light source capable of emitting semiconductor laser light, LED light, liquid crystal shutter light, or the like in the pattern of an image.

Developing Unit

For example, the developing unit 18 is disposed downstream of the portion of the image holding member 12 which is irradiated with the light L emitted from the latent image forming unit 16 in the direction of rotation of the image holding member 12. An accommodating portion that contains a developer is formed inside the developing unit 18. The accommodating portion contains an electrostatic image developer that includes the specific electrostatic image developing toner. The electrostatic image developing toner is, for example, accommodated in the developing unit 18 while being charged.

The developing unit 18 includes, for example, a developing member 18A that develops an electrostatic image formed on the surface of the image holding member 12 with the developer including the electrostatic image developing toner and a power source 32 that applies a developing voltage to the developing member 18A. The developing member 18A is, for example, electrically connected to the power source 32.

The developing member 18A of the developing unit 18 is selected in accordance with the type of the developer used. Examples of the developing member 18A include a developing roller including a developing sleeve with a magnet embedded therein.

The developing unit 18 (including the power source 32) is, for example, electrically connected to the controller 36 disposed in the image forming apparatus 10. Upon the developing unit 18 being driven by the controller 36, the developing unit 18 applies a developing voltage to the developing member 18A. The developing member 18A to which the developing voltage has been applied is charged to a developing potential corresponding to the developing voltage. The developing member 18A charged to the developing potential, for example, holds the developer included in the developing unit 18 on the surface and supplies the electrostatic image developing toner included in the developer from the developing unit 18 onto the surface of the image holding member 12. On the surface of the image holding member 12 onto which the electrostatic image developing toner has been supplied, the electrostatic image is developed to form an electrostatic image developing toner image.

Transfer Unit

The transfer unit 31 is, for example, disposed downstream of the position at which the developing member 18A is disposed, in the direction of rotation of the image holding member 12. The transfer unit 31 includes, for example, a transfer member 20 that transfers the electrostatic image developing toner image formed on the surface of the image holding member 12 to a recording medium 30A and a power source 30 that applies a transfer voltage to the transfer member 20. The transfer member 20 is, for example, cylindrical and transports the recording medium 30A by pinching the recording medium 30A between the image holding member 12 and the transfer member 20. The transfer member 20 is, for example, electrically connected to the power source 30.

Examples of the transfer member 20 include contact transfer chargers including a belt, a roller, a film, a rubber cleaning blade, or the like; and known contactless transfer chargers which use corona discharge, such as a scorotron transfer charger and a corotron transfer charger.

The transfer unit 31 (including the power source 30) is, for example, electrically connected to the controller 36 disposed in the image forming apparatus 10. Upon the transfer unit 31 being driven by the controller 36, the transfer unit 31 applies a transfer voltage to the transfer member 20. The transfer member 20 to which the transfer voltage has been applied is charged to a transfer potential corresponding to the transfer voltage.

Upon the transfer voltage having a polarity opposite to that of the electrostatic image developing toner constituting the electrostatic image developing toner image formed on the image holding member 12 being applied from the power source 30 of the transfer member 20 to the transfer member 20, for example, a transfer electric field having a field intensity that causes the electrostatic image developing toner particles constituting the electrostatic image developing toner image formed on the image holding member 12 to migrate from the image holding member 12 toward the transfer member 20 due to electrostatic force is generated in the region in which the image holding member 12 and the transfer member 20 face each other (see the transfer region 32A in FIG. 1).

The recording medium 30A is, for example, accommodated in an accommodating portion (not illustrated). The recording medium 30A is transported from the accommodating portion along a transport channel 34 by plural transporting members (not illustrated) to reach the transfer region 32A, which is the region in which the image holding member 12 and the transfer member 20 face each other. In the example illustrated in FIG. 1, the recording medium 30A is transported in the direction of the arrow B. To the recording medium 30A that has reached the transfer region 32A, for example, the electrostatic image developing toner image formed on the image holding member 12 is transferred by the transfer electric field generated in the region upon the transfer voltage being applied to the transfer member 20. That is, the electrostatic image developing toner image is transferred to the recording medium 30A as a result of, for example, the migration of the electrostatic image developing toner from the surface of the image holding member 12 to the recording medium 30A. The electrostatic image developing toner image formed on the image holding member 12 is transferred to the recording medium 30A by the transfer electric field.

Cleaning Unit

The image forming apparatus according to the exemplary embodiment includes a cleaning unit that removes toner particles that remain on the image holding member. The cleaning unit includes a unit A that includes a cleaning blade arranged to contact with the surface of the image holding member. A portion of the cleaning blade which contacts with the image holding member has a JIS-A hardness of 90° or more. In another case, the cleaning unit includes a unit B that includes a cleaning blade arranged to contact with the surface of the image holding member and controls a load with which the cleaning blade contacts with the image holding member in a constant load mode.

The cleaning unit may be either the unit A or the unit B. Alternatively, the cleaning unit may be a unit that serves as both units A and B, that is, specifically, a unit that includes a cleaning blade arranged to contact with the surface of the image holding member, a portion of the cleaning blade which contacts with the image holding member having a JIS-A hardness of 90° or more, and controls a load with which the cleaning blade contacts with the image holding member in a constant load mode. The above-described image forming apparatus may reduce the occurrence of image defects in the images formed with the image forming apparatus.

In particular, the cleaning unit may be a unit that serves as both units A and B in order to reduce the occurrence of image defects in the images formed with the image forming apparatus.

The cleaning unit 22 is disposed downstream of the transfer region 32A in the direction of rotation of the image holding member 12. The cleaning unit 22 removes remaining toner particles adhered to the image holding member 12 subsequent to the transfer of the electrostatic image developing toner image to the recording medium 30A. The cleaning unit 22 also removes the matter adhered to the image holding member 12, such as paper dust particles, in addition to remaining toner particles.

The cleaning unit 22 includes a cleaning blade 220 and removes the matter adhered on the surface of the image holding member 12 by contacting the cleaning blade 220 with the image holding member 12 such that the edge of the cleaning blade 220 is pointed in the direction opposite to the direction of rotation of the image holding member 12.

The cleaning unit 22 is described with reference to FIG. 4.

Figure 4:
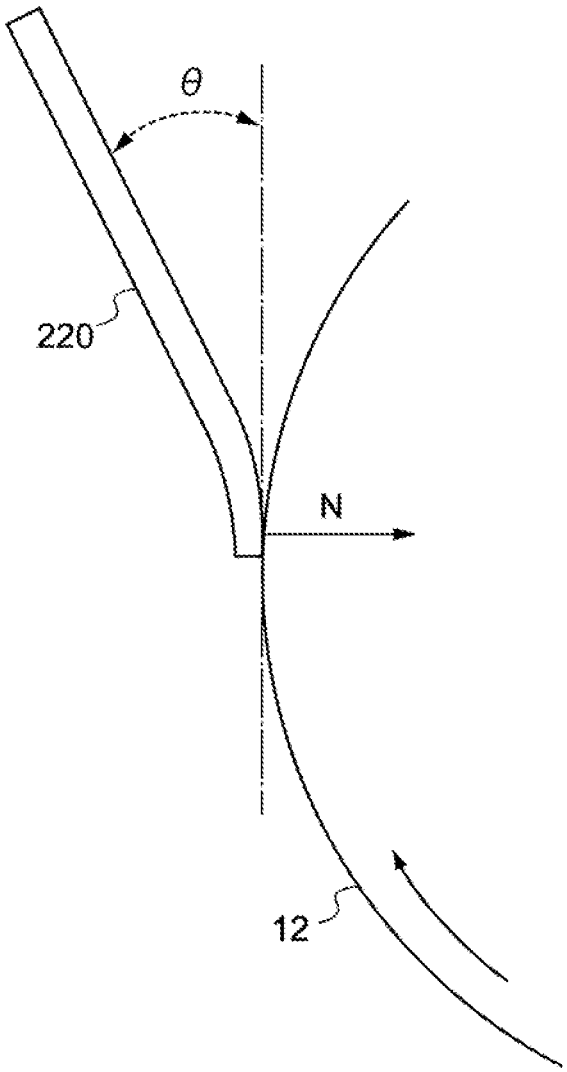
FIG. 4 is an enlarged view of the portion of the image forming apparatus illustrated in FIG. 1 at which a cleaning blade contacts with an image holding member.

FIG. 4 is a schematic diagram illustrating the state in which the cleaning blade 220 is disposed in the cleaning unit 22 illustrated in FIG. 1.

As illustrated in FIG. 4, the edge of the cleaning blade 220 is pointed in the direction opposite to the direction (the direction of the arrow) of rotation of the image holding member 12. The cleaning blade 220 is arranged to contact with the surface of the image holding member 12 in such a state.

The angle θ formed by the cleaning blade 220 and the image holding member 12 is preferably set to 5° or more and 35° or less and is more preferably set to 10° or more and 25° or less.

The pressing force N at which the cleaning blade 220 is pressed against the image holding member 12 may be set to 0.6 gf/mm$^2$ or more and 6.0 gf/mm$^2$ or less.

The angle θ is, specifically, the angle formed by the tangent (the dashed line in FIG. 4) to the image holding member 12 at the position at which the edge of the cleaning blade 220 contacts with the image holding member 12 and the non-deformed part of the cleaning blade 220 as illustrated in FIG. 4.

The pressing force N is the pressure (gf/mm$^2$) at which the cleaning blade 220 is pressed against the image holding member 12 toward the center of the image holding member 12 at the position at which the cleaning blade 220 contacts with the image holding member 12, as illustrated in FIG. 4.

The cleaning blade 220 is provided with a supporting member (not illustrated in FIG. 4) joined to the surface opposite to the surface that contacts with the image holding member 12. The cleaning blade 220 is supported by the supporting member. The supporting member enables the cleaning blade 220 to be pressed against the image holding member 12 at the above pressing force. Examples of the material for the supporting member include metals, such as aluminum and stainless steel. An adhesive layer composed of an adhesive or the like may be interposed between the supporting member and the cleaning blade 220 in order to increase the adhesion therebetween.

The cleaning unit may include any known member other than the cleaning blade 220 or the supporting member that supports the cleaning blade 220.

Unit A

The unit A is a unit that includes a cleaning blade arranged to contact with the surface of the image holding member. A portion of the cleaning blade which contacts with the image holding member has a JIS-A hardness of 90° or more.

At least a portion of the cleaning blade which contacts with the image holding member may include a plate-like rubber base. The cleaning blade may have a single-layer structure consisting of the rubber base or a multilayer structure including the rubber base and a backing layer disposed on the rear surface of the rubber base (i.e., the surface of the rubber base which does not face the image holding member). The backing layer may include plural sublayers.

The rubber base includes a rubber in whole. The term "rubber" used herein refers to a high-molecular compound that has rubber elasticity at normal temperature (25° C.) Examples of the rubber include a polyurethane, a silicone rubber, a fluorine rubber, a chloroprene rubber, and a butadiene rubber. Among the above rubbers, a polyurethane is preferably used and a highly crystallized polyurethane is more preferably used as a material for the rubber base.

The polyurethane is normally synthesized by polymerizing a polyisocyanate with a polyol. A resin other than a polyol which includes a functional group capable of reacting with an isocyanate group may also be used. The polyurethane may include a hard segment and a soft segment.

The terms "hard segment" and "soft segment" are defined as follows: in the polyurethane, the material constituting the hard segment has a higher hardness than the material constituting the soft segment, and the material constituting the soft segment has a lower hardness than the material constituting the hard segment.

The combination of the material constituting the hard segment (hereinafter, referred to as "hard segment material") and the material constituting the soft segment (hereinafter, referred to as "soft segment material") is not limited. The hard segment material and the soft segment material may be selected from known materials such that one of the two materials has a higher hardness than the other and the other has a lower hardness than the one. For example, the following combination may be used.

Soft Segment Material

Examples of the soft segment material include the following polyols: polyester polyol produced by dehydration condensation of a diol and a dibasic acid; polycarbonate polyol produced by reaction of a diol with an alkyl carbonate; polycaprolactone polyol; and polyether polyol. Examples of the above polyols used as a soft segment material which are commercially available include "PLACCEL 205" and "PLACCEL 240" produced by Daicel Corporation.

Hard Segment Material

The hard segment material may be a resin that includes a functional group capable of reacting with an isocyanate group. Furthermore, the hard segment material may be a flexible resin. In consideration of flexibility, in particular, the hard segment material may be an aliphatic resin having a linear structure. Specific examples of such a resin include an acrylic resin including two or more hydroxyl groups, a polybutadiene resin including two or more hydroxyl groups, and an epoxy resin including two or more epoxy groups.

Examples of the acrylic resin including two or more hydroxyl groups which are commercially available include "ACTFLOW (UMB-2005B, UMB-2005P, UMB-2005, and UME-2005)" produced by Soken Chemical & Engineering Co., Ltd.

Examples of the polybutadiene resin including two or more hydroxyl groups which are commercially available include "R-45HT" produced by Idemitsu Kosan Co., Ltd.

The epoxy resin including two or more epoxy groups may be an epoxy resin having higher flexibility and higher toughness than the epoxy resins known in the related art but not an epoxy resin that is hard and brittle like the typical epoxy resins known in the related art. For example, as for the molecular structure, the backbone structure of the epoxy resin may include a structure capable of increasing the mobility of the backbone, that is, a flexible skeleton. Examples of the flexible skeleton include an alkylene skeleton, a cycloalkane skeleton, and a polyoxyalkylene skeleton. In particular, a polyoxyalkylene skeleton may be used.

As for physical properties, an epoxy resin having a low viscosity relative to molecular weight compared with the epoxy resins known in the related art may be used. Specifically, the weight average molecular weight of the above epoxy resin may be in the range of 900±100. The viscosity of the epoxy resin at 25° C. is preferably in the range of 15,000±5,000 mPa·s and is more preferably in the range of 15,000±3,000 mPa·s. Examples of the epoxy resin having the above properties which are commercially available include "EPLICON EXA-4850-150" produced by DIC Corporation.

In the case where the hard segment material and the soft segment material are used, the mass ratio of the amount of the material constituting the hard segment to the total amount of the hard segment material and the soft segment material (hereinafter, this mass ratio is referred to as "hard segment material ratio") is preferably 10% by mass or more and 30% by mass or less, is more preferably 13% by mass or more and 23% by mass or less, and is further preferably 15% by mass or more and 20% by mass or less.

When the hard segment material ratio is 10% by mass or more, certain abrasion resistance may be achieved. When the hard segment material ratio is 30% by mass or less, the hardness of the rubber base is not excessively increased, the rubber base has certain flexibility and expansibility, and cracking in the rubber base may be reduced.

Polyisocyanate

Examples of the polyisocyanate used for synthesizing the polyurethane include 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI).

Among the above polyisocyanates, in particular, 4,4'-diphenylmethane diisocyanate (MDI), 1,5-naphthalene diisocyanate (NDI), and hexamethylene diisocyanate (HDI)

may be used in consideration of ease of formation of hard segment aggregates having the intended particle size.

The amount of the polyisocyanate used is preferably 20 parts by mass or more and 40 parts by mass or less, is more preferably 20 parts by mass or more and 35 parts by mass or less, and is further preferably 20 parts by mass or more and 30 parts by mass or less relative to 100 parts by mass of the resin including a functional group capable of reacting with an isocyanate group.

When the amount of the polyisocyanate is 20 parts by mass or more, a large amount of urethane linkages may be maintained and the hard segment may be grown. This enables the intended hardness to be achieved. When the amount of the polyisocyanate is 40 parts by mass or less, the size of the hard segment is not excessively increased and certain expansibility may be achieved. This may reduce cracking in the cleaning blade.

Crosslinking Agent

Examples of the crosslinking agent include a diol (difunctional), a triol (trifunctional), and a tetraol (tetrafunctional). The above crosslinking agents may be used in combination. An amine compound may also be used as a crosslinking agent. Crosslinks may be formed using a trifunctional or higher crosslinking agent. Examples of trifunctional crosslinking agents include trimethylolpropane, glycerin, and triisopropanolamine.

The amount of the crosslinking agent used may be 2 parts by mass or less relative to 100 parts by mass of the resin including a functional group capable of reacting with an isocyanate group. When the amount of the crosslinking agent used is 2 parts by mass or less, the movement of the molecules is not restricted by the chemical crosslinks and the hard segment derived from urethane linkages may be grown to a large size by aging. This enables the intended hardness to be readily achieved.

Method for Forming Rubber Base

A rubber base that includes polyurethane, which is an example of a rubber, may be produced by a common method for producing polyurethane, such as a prepolymer method or a one-shot method. Although a prepolymer method enables the production of a polyurethane having a high strength and high abrasion resistance, the production method is not limited thereto.

The polyurethane is produced by mixing the above-described polyol with the polyisocyanate compound, the crosslinking agent, and the like and formed into a shape. The rubber base is prepared by forming the rubber base forming composition prepared by the above method into a sheet-like shape by centrifugal molding, extrusion molding, or the like and subjecting the resulting sheet-like body to cutting or the like.

Physical Properties

In the case where the rubber included in the rubber base is a polyurethane, the weight average molecular weight of the polyurethane is preferably 1,000 or more and 4,000 or less and is more preferably 1,500 or more and 3,500 or less.

The JIS-A hardness ($H_{BLD}$) of at least the portion of the cleaning blade which contacts with the image holding member is preferably 60° or more, is more preferably 70° or more, is further preferably 90° or more, and is particularly preferably 90° or more and 100° or less in order to reduce the occurrence of image defects in the images formed with the image forming apparatus.

JIS-A hardness is the hardness measured with a Type A Durometer described in JIS K 7215 (1986) in accordance with the hardness testing method described in JIS K 7311 (1995).

The expression "the portion of the cleaning blade which contacts with the image holding member" refers to both the portion of the cleaning blade which contacts with the image holding member while the rotation of the image holding member is stopped and the portion of the cleaning blade which contacts with the image holding member while the image holding member is rotated.

The JIS-A hardness of at least the portion of the cleaning blade which contacts with the image holding member may be controlled to be 90° or more by, for example, changing the material constituting the contacting portion; hardening the contacting portion; changing the combination of the hard segment material and the soft segment material; changing the mixing ratio between the hard segment material and the soft segment material; or changing the conditions (e.g., aging time and aging temperature) under which the rubber base forming composition (i.e., the composition used for forming the cleaning blade) is cured.

The ratio ($H_{BLD}/H_{OCL}$) of the hardness ($H_{BLD}$) of the cleaning blade to the hardness ($H_{OCL}$) of the protection layer is preferably 0.8 or less, is more preferably 0.7 or less, and is further preferably 0.6 or less in order to reduce the occurrence of image defects in the images formed with the image forming apparatus.

Figure 6:
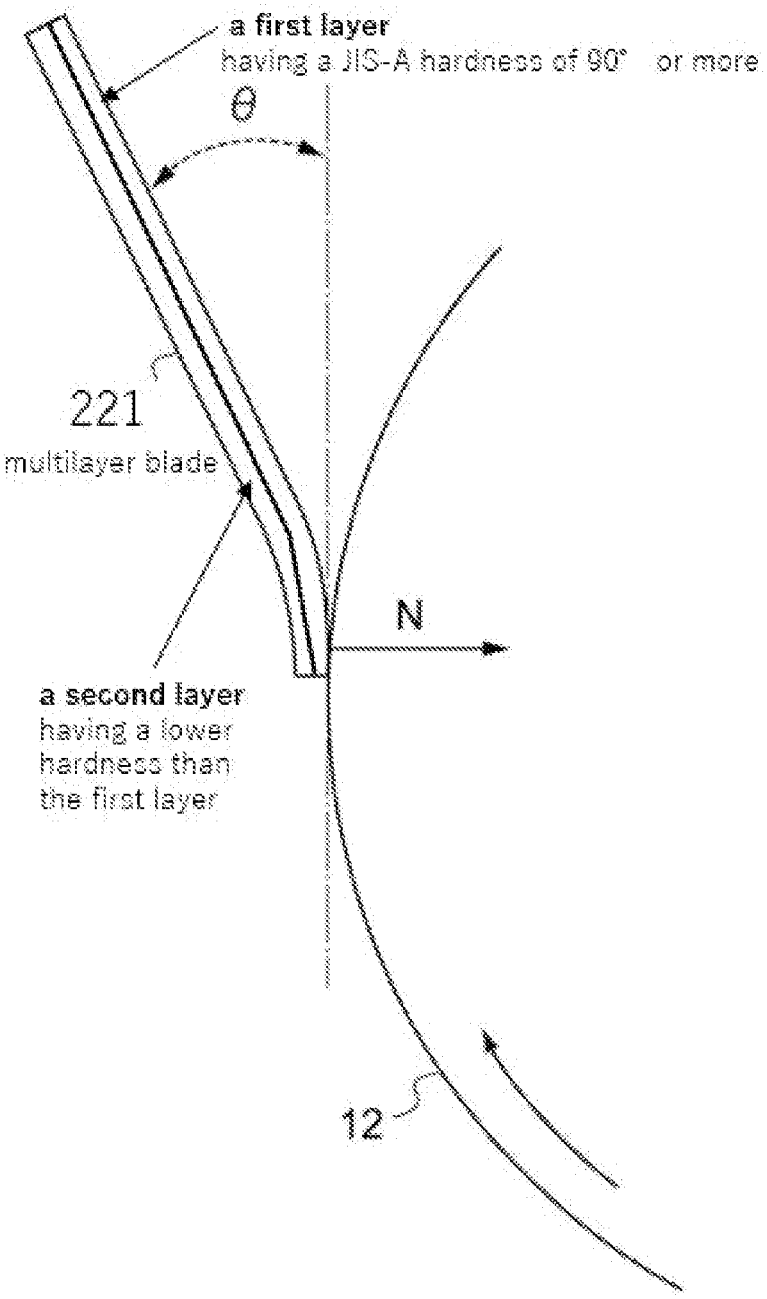
FIG. 6 is an enlarged view of a multilayer cleaning blade in contact with an image holding member.

As shown in FIG. 6, the cleaning blade is preferably a multilayer blade and is more preferably a multilayer blade constituted by a layer having a JIS-A hardness of 90° or more and a layer having a lower hardness than the layer having a JIS-A hardness of 90° or more in order to reduce the occurrence of image defects in the images formed with the image forming apparatus.

The difference in JIS-A hardness between the layer having a JIS-A hardness of 90° or more and the layer having the lower hardness which are included in the cleaning blade is preferably 10° or more, is more preferably 15° or more, is further preferably 15° or more and 40° or less, and is particularly preferably 20° or more and 30° or less in order to reduce the occurrence of image defects in the images formed with the image forming apparatus.

The cleaning blade that includes the contacting portion having a JIS-A hardness of 90° or more is preferably a cleaning blade produced by hardening the contacting portion and is more preferably a multilayer blade that includes a hardened layer disposed on the surface of the multilayer blade which includes the contacting portion in order to reduce the occurrence of image defects in the images formed with the image forming apparatus.

The multilayer blade may be any multilayer blade constituted by two or more layers. In order to reduce the occurrence of image defects in the images formed with the image forming apparatus, the multilayer blade is preferably constituted by two or three layers, is more preferably constituted by two layers, and is particularly preferably constituted by a layer having a JIS-A hardness of 90° or more and a layer having a lower hardness than the layer having a JIS-A hardness of 90° or more.

Examples of the materials constituting the layers included in the multilayer blade include, but are not limited to, the rubber base described above. The materials constituting the layers may be the same resin or different resins. In order to reduce the occurrence of image defects in the images formed with the image forming apparatus, the multilayer blade is preferably constituted by two or more layers that are composed of the same resin but have different degrees of hardness, is more preferably constituted by two or more polyurethane layers having different degrees of hardness, and is particularly preferably constituted by a polyurethane layer that has been subjected to a hardening treatment and a polyurethane layer that has not been subjected to a hardening treatment.

The hardening treatment is not limited. The hardening treatments known in the related art may be selected appropriately in accordance with the type of the resin used.

Examples of the hardening treatment include a hardening treatment in which the crosslinking agents known in the related art are used and the heat treatments known in the related art.

Specific examples of the hardening treatment include a method in which a crosslinking agent, such as the above-described polyisocyanate, a polyhydric alcohol (e.g., the above-described diol, the above-described triol, or the above-described tetraol), or the above-described amine compound, is applied onto the surface of a polyurethane cleaning blade which includes the contacting portion or the surface of the polyurethane cleaning blade which includes the contacting portion is impregnated with the above crosslinking agent and, subsequently, a heat treatment is performed as needed.

The thicknesses of the layers constituting the multilayer blade may be set appropriately as needed. The thickness of each of the layers is not necessarily uniform over the layer.

For example, in the multilayer blade constituted by a layer having a JIS-A hardness of 90° or more and a layer having a lower hardness than the layer having a JIS-A hardness of 90° or more, the thickness of the layer having a JIS-A hardness of 90° or more is preferably 0.01 mm or more and 1.0 mm or less and is more preferably 0.1 mm or more and 0.5 mm or less in order to reduce the occurrence of image defects in the images formed with the image forming apparatus.

The thickness of the layer having a JIS-A hardness of 90° or more is preferably ½ or less and is more preferably ¼ or less of the overall thickness of the multilayer blade in order to reduce the occurrence of image defects in the images formed with the image forming apparatus.

The overall thickness of the cleaning blade is preferably, but not limited to, 0.1 mm or more and 10 mm or less, is more preferably 0.1 mm or more and 3.0 mm or less, and is further preferably 0.2 mm or more and 2.0 mm or less.

The width of the cleaning blade is not limited and may be set appropriately in accordance with the width of the image holding member.

The length of the cleaning blade is not limited and may be set appropriately in accordance with, for example, the shape of the image forming apparatus.

Unit B

The unit B is a unit that includes a cleaning blade arranged to contact with the surface of the image holding member and controls a load with which the cleaning blade contacts with the image holding member (hereinafter, this load is referred to as "contacting load") in a constant load mode.

The description of the components of the unit A also applies to the unit B.

The load with which the cleaning blade contacts with the image holding member, which is controlled by the unit B in a constant load mode, does not necessarily remain absolutely constant but may remain relatively constant. For example, the fluctuations in the contacting load are preferably within 30%, are more preferably within 20%, and are particularly preferably within 10%.

The contacting load is not limited and may be set appropriately as needed. The pressing force at which the cleaning blade is pressed against the image holding member may be 1.0 gf/mm$^2$ or more and 6.0 gf/mm$^2$ or less.

The unit B may include an elastic member as a mechanism by which the unit B controls the contacting load in a constant load mode.

Examples of the elastic member include, but are not limited to, a spring and a member composed of a foam material.

The unit B may be joined to a housing of the image forming apparatus with the elastic member.

In the unit B, the elastic member and the cleaning blade may be joined to each other with a supporting member.

The material constituting the supporting member and the shape of the supporting member are not limited and may be selected appropriately.

The unit B may optionally include a weight used for applying a load in a direction in which the cleaning blade contacts with the image holding member in order to reduce fluctuations in the contacting load.

Figure 5:
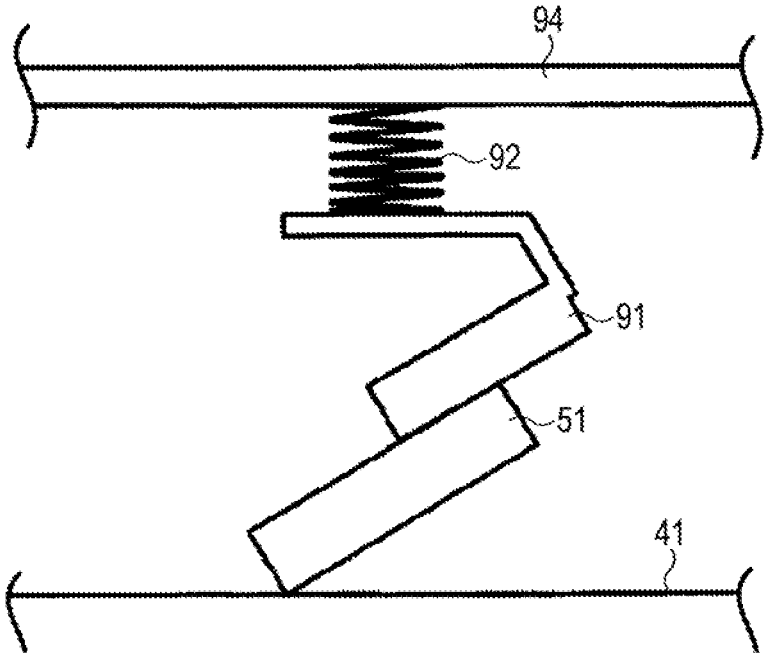
FIG. 5 is a schematic cross-sectional view of an example of a unit B included in an image forming apparatus according to an exemplary embodiment.

FIG. 5 is a schematic cross-sectional view of an example of the unit B included in the image forming apparatus according to the exemplary embodiment.

In the example of the unit B illustrated in FIG. 5 in which the contacting load is controlled in a constant load mode, the supporting member 91 is supported by the housing of the image forming apparatus or a member 94 fixed to the housing with an elastic member, such as a spring 92, interposed between the supporting member 91 and the housing or between the supporting member 91 and the member 94. Therefore, the position of the cleaning blade 51 varies with the reaction force from an image holding member 41, and the cleaning blade 51 is pressed against the image holding member 41 at the predetermined constant load described above.

Note that, in FIG. 5, the cleaning blade 51 becomes deformed as a result of receiving a reaction force from the image holding member 41.

Erasing Unit

The image forming apparatus according to the exemplary embodiment may include an erasing unit that erases static by irradiating the surface of the image holding member with light subsequent to the transfer of the electrostatic image developing toner image.

The erasing unit 24 is disposed, for example, downstream of the cleaning unit 22 in the direction of rotation of the image holding member 12. The erasing unit 24 erases static by irradiating the surface of the image holding member 12 with light subsequent to the transfer of the electrostatic image developing toner image. Specifically, for example, the erasing unit 24 is electrically connected to the controller 36 disposed in the image forming apparatus 10. Upon the erasing unit 24 being driven by the controller 36, the erasing unit 24 erases static by irradiating the entire surface (specifically, e.g., the entirety of the region in which the image is formed) of the image holding member 12 with light.

Examples of the erasing unit 24 include devices that include a light source, such as a tungsten lamp that emits white light or a light-emitting diode (LED) that emits red light.

Fixing Unit

The image forming apparatus according to the exemplary embodiment may include a fixing unit that fixes the toner image transferred on the recording medium.

The fixing unit 26 is disposed, for example, downstream of the transfer region 32A in the direction in which the recording medium 30A is transported along the transport channel 34. The fixing unit 26 includes a fusing member 26A and a pressurizing member 26B arranged to contact with the fusing member 26A. The electrostatic image developing toner image transferred on the recording medium 30A is fixed at the position at which the fusing member 26A and the pressurizing member 26B contact with each other. Specifically, for example, the fixing unit 26 is electrically connected to the controller 36 disposed in the image forming apparatus 10. Upon the fixing unit 26 being driven by the controller 36, the fixing unit 26 fixes the electrostatic image developing toner image transferred on the recording medium 30A to the recording medium 30A by heat and pressure.

Examples of the fixing unit 26 include the fusers known in the related art, such as a heat roller fuser and an oven fuser.

Specifically, for example, the fixing unit 26 may be the fixing unit known in the related art which includes a fusing roller or belt as a fusing member 26A and a pressurizing roller or belt as a pressurizing member 26B.

After the electrostatic image developing toner image has been transferred to the recording medium 30A when the recording medium 30A is transported along the transport channel 34 and passed through the region (i.e., the transfer region 32A) in which the image holding member 12 and the transfer member 20 face each other, for example, the recording medium 30A is further transported by transporting members (not illustrated) along the transport channel 34 and reaches the position at which the fixing unit 26 is disposed. Subsequently, the electrostatic image developing toner image is fixed to the recording medium 30A.

After an image has been formed on the recording medium 30A by fixing of the electrostatic image developing toner image, the recording medium 30A is ejected outside the image forming apparatus 10 by plural transporting members (not illustrated). After the erasing unit 24 has erased static, the image holding member 12 is again charged by the charging unit 15 to a predetermined charge potential.

Actions of Image Forming Apparatus

An example of the actions of the image forming apparatus 10 according to the exemplary embodiment is described below. The actions of the image forming apparatus 10 are done by the control program executed in the controller 36.

The image forming actions of the image forming apparatus 10 are described below.

The surface of the image holding member 12 is charged by the charging unit 15. The latent image forming unit 16 irradiates the charged surface of the image holding member 12 with light on the basis of the image information. Consequently, an electrostatic image corresponding to the image information is formed on the image holding member 12. The developing unit 18 develops the electrostatic image formed on the surface of the image holding member 12 with the developer that includes the specific electrostatic image developing toner to form an electrostatic image developing toner image on the surface of the image holding member 12.

The transfer unit 31 transfers the electrostatic image developing toner image formed on the surface of the image holding member 12 to the recording medium 30A. The electrostatic image developing toner image transferred on the recording medium 30A is fixed by the fixing unit 26.

Subsequent to the transfer of the electrostatic image developing toner image, the surface of the image holding member 12 is cleaned with the cleaning blade 220 included in the cleaning unit 22. Subsequently, static is erased by the erasing unit 24.

Electrostatic Image Developer

The image forming apparatus according to the exemplary embodiment may include an electrostatic image developer that includes an electrostatic image developing toner.

The electrostatic image developer used in the exemplary embodiment may be a single component developer that includes only the toner or may be a two-component developer that includes the toner and a carrier.

Electrostatic Image Developing Toner

The electrostatic image developing toner used in the exemplary embodiment includes toner particles and silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more.

The electrostatic image developing toner used in the exemplary embodiment may optionally include inorganic oxide particles, lubricant particles, and external additive particles other than the inorganic oxide particles or the lubricant particles.

Toner Particles

The toner particles include, for example, a binder resin and may optionally include a colorant, a release agent, and other additives.

Binder Resin

Examples of the binder resin include vinyl resins that are homopolymers of the following monomers or copolymers of two or more monomers selected from the following monomers: styrenes, such as styrene, para-chlorostyrene, and α-methylstyrene; (meth)acrylates, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; ethylenically unsaturated nitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; and olefins, such as ethylene, propylene, and butadiene.

Examples of the binder resin further include non-vinyl resins, such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

The above binder resins may be used alone or in combination of two or more.

(1) Styrene Acrylic Resin

The binder resin may be a styrene acrylic resin.

A styrene acrylic resin is a copolymer produced by copolymerization of at least a monomer including a styrene skeleton (hereinafter, referred to as "styrene-based monomer") with a monomer that includes a (meth)acryloyl group and preferably includes a (meth)acryloyloxy group (hereinafter, referred to as "(meth)acryl-based monomer"). The styrene acrylic resin includes, for example, a copolymer of a monomer selected from the styrenes with a monomer selected from the above-described (meth)acrylate esters. The acrylic resin portion of the styrene acrylic resin is a structural unit produced by polymerization of an acryl-based monomer, a methacryl-based monomer, or both acryl-based monomer and methacryl-based monomer. The term "(meth) acryl" used herein refers to both "acryl" and "methacryl".

Specific examples of the styrene-based monomer include styrene; alkyl-substituted styrenes, such as α-methylstyrene, 2-methylstyrene, 3-methylstyrene, 4-methylstyrene, 2-ethylstyrene, 3-ethylstyrene, and 4-ethylstyrene; halogen-substituted styrenes, such as 2-chlorostyrene, 3-chlorostyrene, and 4-chlorostyrene; and vinylnaphthalene. The above styrene-based monomers may be used alone or in combination of two or more.

Among these styrene-based monomers, styrene is preferable in terms of ease of reaction, ease of controlling reaction, and ease of availability.

Specific examples of the (meth)acryl-based monomer include (meth)acrylic acid and (meth)acrylate esters. Examples of the (meth)acrylate esters include alkyl (meth) acrylate esters, such as methyl (meth)acrylate, ethyl (meth) acrylate, n-propyl (meth)acrylate, n-butyl (meth)acrylate, n-pentyl (meth)acrylate, n-hexyl acrylate, n-heptyl (meth) acrylate, n-octyl (meth)acrylate, n-decyl (meth)acrylate, n-dodecyl (meth)acrylate, n-lauryl (meth) acrylate, n-tetradecyl (meth) acrylate, n-hexadecyl (meth) acrylate, n-octadecyl (meth) acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth) acrylate, 2-ethylhexyl (meth) acrylate, cyclohexyl (meth)acrylate, and t-butylcyclohexyl (meth)acrylate); aryl (meth)acrylate esters, such as phenyl (meth)acrylate, biphenyl (meth)acrylate, diphenylethyl (meth)acrylate, t-butylphenyl (meth)acrylate, and terphenyl (meth)acrylate; dimethylaminoethyl (meth) acrylate; diethylaminoethyl (meth) acrylate; methoxyethyl (meth) acrylate; 2-hydroxyethyl (meth)acrylate; β-carboxyethyl (meth)acrylate; and (meth)acrylamide. The above (meth)acryl-based monomers may be used alone or in combination of two or more.

Among the above (meth)acrylate esters, a (meth)acrylate ester including an alkyl group having 2 to 14 carbon atoms, preferably having 2 to 10 carbon atoms, and more preferably having 3 to 8 carbon atoms is preferable in order to enhance the fixability of the toner. In particular, n-butyl (meth) acrylate is preferable, and n-butyl acrylate is particularly preferable.

The copolymerization ratio between the styrene-based monomer and the (meth)acryl-based monomer (by mass, [Styrene-based monomer]/[(Meth)acryl-based monomer]) may be, but not limited to, 85/15 to 60/40.

The styrene acrylic resin may include a crosslinked structure. The styrene acrylic resin including a crosslinked structure is, for example, a copolymer of at least the styrene-based monomer, the (meth)acryl-based monomer, and a crosslinkable monomer.

Examples of the crosslinkable monomer include crosslinking agents having two or more functional groups.

Examples of the difunctional crosslinking agent include divinylbenzene; divinylnaphthalene; di(meth)acrylates, such as diethylene glycol di(meth)acrylate, methylene bis (meth)acrylamide, decanediol diacrylate, and glycidyl (meth)acrylate; polyester di(meth)acrylate; and 2-([1'-methylpropylideneamino]carboxyamino)ethyl methacrylate.

Examples of the crosslinking agents having three or more functional groups include tri(meth)acrylates, such as pentaerythritol tri(meth)acrylate, trimethylolethane tri(meth) acrylate, and trimethylolpropane tri(meth)acrylate; tetra(meth)acrylates, such as pentaerythritol tetra(meth)acrylate and oligoester (meth)acrylate; 2,2-bis(4-methacryloxy polyethoxyphenyl)propane; diallyl phthalate; triallyl cyanurate; triallyl isocyanurate; triallyl trimellitate; and diallyl chlorendate.

Among the above crosslinkable monomers, in order to enhance the fixability of the toner, a (meth)acrylate having two or more functional groups is preferable, a difunctional (meth)acrylate is more preferable, a difunctional (meth) acrylate including an alkylene group having 6 to 20 carbon atoms is further preferable, and a difunctional (meth)acrylate including a linear alkylene group having 6 to 20 carbon atoms is particularly preferable.

The copolymerization ratio of the crosslinkable monomer to all the monomers (by mass, [Crosslinkable monomer]/[All monomers]) may be, but not limited to, 2/1,000 to 20/1,000.

The glass transition temperature (Tg) of the styrene acrylic resin is preferably 40° C. or more and 75° C. or less and is more preferably 50° C. or more and 65° C. or less in order to enhance the fixability of the toner.

Glass transition temperature is determined from a differential scanning calorimetry (DSC) curve obtained by DSC. More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight average molecular weight of the styrene acrylic resin is preferably 5,000 or more and 200,000 or less, is more preferably 10,000 or more and 100,000 or less, and is particularly preferably 20,000 or more and 80,000 or less in order to enhance the preservation stability of the toner.

The method for preparing the styrene acrylic resin is not limited; various polymerization methods, such as solution polymerization, precipitation polymerization, suspension polymerization, bulk polymerization, and emulsion polymerization, may be used. The polymerization reaction may be conducted by any suitable process known in the related art, such as a batch process, a semi-continuous process, or a continuous process.

(2) Polyester Resin

The binder resin may be a polyester resin.

Examples of the polyester resin include amorphous (i.e., non-crystalline) polyester resins known in the related art. A crystalline polyester resin may be used as a polyester resin in combination with an amorphous polyester resin. In such a case, the content of the crystalline polyester resin in the binder resin may be 2% by mass or more and 40% by mass or less and is preferably 2% by mass or more and 20% by mass or less.

The term "crystalline" resin used herein refers to a resin that, in thermal analysis using differential scanning calorimetry (DSC), exhibits a distinct endothermic peak instead of step-like endothermic change and specifically refers to a resin that exhibits an endothermic peak with a half-width of 10° C. or less at a heating rate of 10° C./min.

On the other hand, the term "amorphous" resin used herein refers to a resin that exhibits an endothermic peak with a half-width of more than 10° C., that exhibits step-like endothermic change, or that does not exhibit a distinct endothermic peak.

Amorphous Polyester Resin

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenyl succinic acid, adipic acid, and sebacic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of these dicarboxylic acids; and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols, such as ethylene glycol, diethylene glycol, triethylene glycol, propylene glycol, butanediol, hexanediol, and neopentyl glycol; alicyclic diols, such as cyclohexanediol, cyclohexanedimethanol, and hydrogenated bisphenol A; and aromatic diols, such as bisphenol A-ethylene oxide adducts and bisphenol A-propylene oxide adducts. Among these diols, for example, aromatic diols and alicyclic diols may be used as a polyhydric alcohol. In particular, aromatic diols may be used as a polyhydric alcohol.

Trihydric or higher alcohols having a crosslinked structure or a branched structure may be used as a polyhydric alcohol in combination with the diols. Examples of the trihydric or higher alcohols include glycerin, trimethylolpropane, and pentaerythritol.

The above polyhydric alcohols may be used alone or in combination of two or more.

The glass transition temperature Tg of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight average molecular weight Mw of the amorphous polyester resin is preferably 5,000 or more and 1,000,000 or less and is more preferably 7,000 or more and 500,000 or less.

The number average molecular weight Mn of the amorphous polyester resin is preferably 2,000 or more and 100,000 or less.

The molecular weight distribution index Mw/Mn of the amorphous polyester resin is preferably 1.5 or more and 100 or less and is more preferably 2 or more and 60 or less.

The weight average molecular weight and number average molecular weight of the amorphous polyester resin are determined by gel permeation chromatography (GPC). Specifically, the molecular weights of the amorphous polyester resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight average molecular weight and number average molecular weight of the amorphous polyester resin are determined on the basis of the results of the measurement using a molecular weight calibration curve based on monodisperse polystyrene standard samples.

The amorphous polyester resin may be produced by any suitable production method known in the related art. Specifically, the amorphous polyester resin may be produced by, for example, a method in which polymerization is performed at 180° C. or more and 230° C. or less, the pressure inside the reaction system is reduced as needed, and water and alcohols that are generated by condensation are removed.

In the case where the raw materials, that is, the monomers, are not dissolved in or miscible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where the monomers have low miscibility with each other, a condensation reaction of the monomers with an acid or alcohol that is to undergo a polycondensation reaction with the monomers may be performed in advance and subsequently polycondensation of the resulting polymers with the other components may be performed.

Crystalline Polyester Resin

Examples of the crystalline polyester resin include condensation polymers of a polyvalent carboxylic acid and a polyhydric alcohol. The crystalline polyester resin may be commercially available one or a synthesized one.

In order to increase ease of forming a crystal structure, a condensation polymer prepared from linear aliphatic polymerizable monomers may be used as a crystalline polyester resin instead of a condensation polymer prepared from aromatic polymerizable monomers.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids. Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The melting temperature of the crystalline polyester resin is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The crystalline polyester resin may have a weight average molecular weight Mw of 6,000 or more and 35,000 or less.

The crystalline polyester resin may be produced by any suitable method known in the related art similarly to, for example, the amorphous polyester resin.

The content of the binder resin in the toner particles is preferably, for example, 40% by mass or more and 95% by mass or less, is more preferably 50% by mass or more and 90% by mass or less, and is further preferably 60% by mass or more and 85% by mass or less.

Colorant

Examples of the colorant include various pigments, such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the toner particles is preferably, for example, 1% by mass or more and 30% by mass or less and is more preferably 3% by mass or more and 15% by mass or less.

Release Agent

Examples of the release agent include, but are not limited to, hydrocarbon waxes; natural waxes, such as a carnauba wax, a rice bran wax, and a candelilla wax; synthetic or mineral-petroleum-derived waxes, such as a montan wax; and ester waxes, such as a fatty-acid ester wax and a montanate wax.

The melting temperature of the release agent is preferably 50° C. or more and 110° C. or less and is more preferably 60° C. or more and 100° C. or less.

The melting temperature of the release agent is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The content of the release agent in the toner particles is preferably, for example, 1% by mass or more and 20% by mass or less and is more preferably 5% by mass or more and 15% by mass or less.

Other Additives

Examples of the other additives include additives known in the related art, such as a magnetic substance, a charge controlling agent, and an inorganic powder. These additives may be added to the toner particles as internal additives.

Properties, etc. of Toner Particles

The toner particles may have a single-layer structure or a "core-shell" structure constituted by a core (i.e., core particle) and a coating layer (i.e., shell layer) covering the core.

The core-shell structure of the toner particles may be constituted by, for example, a core including a binder resin and, as needed, other additives such as a colorant and a release agent and by a coating layer including the binder resin.

The volume average diameter D50v of the toner particles is preferably 2 μm or more and 10 μm or less and is more preferably 4 μm or more and 8 μm or less.

The above-described average diameters and particle diameter distribution indices of the toner particles are measured using "COULTER MULTISIZER II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5%-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER MULTISIZER II with an aperture having a diameter of 100 μm. The number of the particles sampled is 50,000.

The particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter D16v and the number particle diameter D16p, respectively. Particle diameters at which the cumulative volume and the cumulative number reach 50% are considered to be the volume average particle diameter D50v and the number average particle diameter D50p, respectively. Particle diameters at which the cumulative volume and the cumulative number reach 84% are considered to be the volume particle diameter D84v and the number particle diameter D84p, respectively.

Using the volume particle diameters and number particle diameters measured, the volume particle size distribution index (GSDv) is calculated as $(D84v/D16v)^{1/2}$ and the number particle size distribution index (GSDp) is calculated as $(D84p/D16p)^{1/2}$.

The toner particles preferably have an average circularity of 0.94 or more and 1.00 or less. The average circularity of the toner particles is more preferably 0.95 or more and 0.98 or less.

The average circularity of the toner particles is determined as [Equivalent circle perimeter]/[Perimeter] (i.e., [Perimeter of a circle having the same projection area as the particles]/[Perimeter of the projection image of the particles]. Specifically, the average circularity of the toner particles is determined by the following method.

The toner particles to be measured are sampled by suction so as to form a flat stream. A static image of the particles is taken by instantaneously flashing a strobe light. The image of the particles is analyzed with a flow particle image analyzer "FPIA-3000" produced by Sysmex Corporation. The number of samples used for determining the average circularity of the toner particles is 3,500.

In the case where the toner includes an external additive, the toner (i.e., the developer) to be measured is dispersed in water containing a surfactant and then subjected to an ultrasonic wave treatment in order to remove the external additive from the toner particles.

First Silica Particles

The toner used in the exemplary embodiment includes silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more. Hereinafter, such silica particles may be referred to as "first silica particles".

Since the image forming apparatus according to the exemplary embodiment includes a toner that includes the first silica particles as an external additive, the image forming apparatus may reduce filming of the external additive on the image holding member.

The number average particle size of the first silica particles is 110 nm or more and 130 nm or less. The number average particle size of the first silica particles is preferably 113 nm or more and 127 nm or less and is more preferably 115 nm or more and 125 nm or less in order to reduce the occurrence of image defects in the images formed with the image forming apparatus.

The method for controlling the number average particle size of the first silica particles to fall within the above range is not limited. The number average particle size of the first silica particles may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentrations of the alkali catalyst and tetraalkoxysilane may be adjusted.

The large-diameter-side number particle size distribution index (upper GSDp) of the first silica particles is less than 1.080. The upper GSDp of the first silica particles is preferably 1.077 or less and is more preferably less than 1.075 in order to reduce the occurrence of image defects in the images formed with the image forming apparatus.

The small-diameter-side number particle size distribution index (lower GSDp) of the first silica particles is preferably less than 1.080 and is more preferably 1.075 or less in order to reduce the occurrence of image defects in the images formed with the image forming apparatus.

The method for controlling the upper GSDp and lower GSDp of the first silica particles to fall within the above ranges is not limited. The upper GSDp and lower GSDp of the first silica particles may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentrations of the alkali catalyst and tetraalkoxysilane may be adjusted.

The number average particle size, the upper GSDp, and the lower GSDp of the first silica particles are determined in the following manner.

(1) The toner is dispersed in methanol. After the resulting dispersion liquid has been stirred at room temperature (23° C.), the dispersion liquid is subjected to an ultrasonic bath in order to separate the external additive from the toner. Subsequently, centrifugal separation is performed to precipitate toner particles and collect a dispersion liquid containing the external additive dispersed therein. Then, methanol is removed by distillation and the external additive is extracted.

(2) The external additive is dispersed on the surface of the resin particle having a volume average particle size of 100 μm (polyester particles, weight average molecular weight Mw: 50,000).

(3) The resin particle on which the external additive is dispersed is observed with a scanning electron microscope (SEM) "S-4800" produced by Hitachi High-Technologies Corporation equipped with an energy dispersive X-ray (EDX) analyzer "EMAX Evolution X-Max 80=2" produced by HORIBA, Ltd. An image of the external additive is taken at a 40,000-fold magnification. Then, by EDX analysis, on the basis of the presence of Si, 300 or more primary particles of silica are identified in one field of view. The SEM observation is conducted with an accelerating voltage of 15 kV, an emission current of 20 μA, and a working distance (WD) of 15 mm. The EDX analysis is conducted under the same conditions as above for a detection time of 60 minutes.

(4) The resulting image is captured into an image processor "LUZEXIII" produced by NIRECO CORPORATION. The area of each particle is measured by image analysis.

(5) The size of each silica particle is calculated on the basis of the area calculated above in terms of equivalent circle diameter.

(6) 100 silica particles having an equivalent circle diameter of 80 nm or more are selected.

For the selected silica particles, a cumulative distribution curve is drawn in ascending order in terms of equivalent circle diameter. The particle size at which the cumulative number reaches 50% is considered the number average particle size of the first silica particles.

For the selected silica particles, a cumulative distribution curve is drawn in ascending order in terms of equivalent circle diameter. The particle size at which the cumulative number reaches 16% is considered the number particle size D16p. The particle size at which the cumulative number reaches 50% is considered the number average particle size D50p. The particle size at which the cumulative number reaches 84% is considered the number particle size D84p. The large-diameter-side number particle size distribution index (upper GSDp) is calculated as $(D84p/D50p)^{1/2}$. The small-diameter-side number particle size distribution index (lower GSDp) is calculated as $(D50p/D16p)^{1/2}$.

The average circularity of the first silica particles is 0.94 or more and 0.98 or less. The average circularity of the first silica particles is preferably 0.945 or more and 0.975 or less and is more preferably 0.950 or more and 0.970 or less in order to reduce the occurrence of image defects in the images formed with the image forming apparatus.

The method for controlling the average circularity of the first silica particles to fall within the above range is not limited. The average circularity of the first silica particles may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentration of the alkali catalyst may be adjusted.

The proportion of the first silica particles having a circularity of 0.92 or more is 80 number % or more. The proportion of the first silica particles having a circularity of 0.92 or more is preferably 85 number % or more and is more preferably 87 number % or more in order to reduce the occurrence of image defects in the images formed with the image forming apparatus.

The method for controlling the proportion of the first silica particles having a circularity of 0.92 or more to fall within the above range is not limited. The proportion of the first silica particles having a circularity of 0.92 or more may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentration of the alkali catalyst may be adjusted.

The average circularity of the first silica particles and the proportion of the first silica particles having a circularity of 0.92 or more are determined in the following manner.

The circularity of each of the 100 silica particles selected in the measurement of the number average particle size of the first silica particles, which is described above, is calculated using Formula (1) below. The circularity at which the frequency calculated in ascending order in terms of circularity reaches 50% is considered the average circularity of the first silica particles.

$$\text{Circularity}=4\pi\times(A/I^2) \quad (1)$$

where I represents the perimeter of a primary particle on the image; and A represents the projected area of the primary particle on the image.

The number proportion of silica particles having a circularity of 0.92 or more in the 100 silica particles used in the calculation of average circularity is considered the number proportion of the first silica particles having a circularity of 0.92 or more.

The degree of hydrophobicity of the first silica particles is preferably 50% or more and 80% or less, is more preferably 50% or more and 75% or less, and is further preferably 50% or more and 70% or less in order to reduce the occurrence of image defects in the images formed with the image forming apparatus.

The method for controlling the degree of hydrophobicity of the first silica particles to fall within the above range is not limited. The degree of hydrophobicity of the first silica particles may be controlled by, for example, using sol gel silica particles as first silica particles and, in the production of the sol gel silica particles, subjecting the surfaces of the silica particles to a hydrophobic treatment using a hydrophobizing agent in the presence of supercritical carbon dioxide.

The degree of hydrophobicity of the first silica particles is determined in the following manner.

To 50 ml of ion-exchange water, 0.2% by mass of the sample, that is, the silica particles, is added. While the resulting mixture is stirred with a magnetic stirrer, methanol is added dropwise from a buret to the mixture. The mass fraction (%) of methanol in the methanol-ion exchange water mixed solution (=Amount of methanol added/[Amount of methanol added+Amount of ion-exchange water]) measured at the endpoint at which the whole amount of the sample settles in the solution is considered the degree of hydrophobicity (%).

The first silica particles may be any particles composed primarily of silica, that is, $SiO_2$, and may be either crystalline or amorphous. The first silica particles may be particles produced using a silicon compound, such as water glass or alkoxysilane, as a raw material and may be particles produced by pulverizing quartz. Examples of the first silica particles include sol gel silica particles; aqueous colloidal silica particles; alcoholic silica particles; fumed silica particles produced by a gas phase method or the like; and fused silica particles. Among the above silica particles, sol gel silica particles are preferably included in the first silica particles.

Sol gel silica particles may be produced by, for example, the following method. Tetraalkoxysilane (e.g., TMOS) is added dropwise to an alkali catalyst solution containing an alcohol compound and ammonia water to cause hydrolysis and condensation of tetraalkoxysilane and form a suspension containing sol gel silica particles. The solvent is removed from the suspension to obtain particulate matter. The particulate matter is dried to form sol gel silica particles.

The first silica particles may be silica particles hydrophobized with a hydrophobizing agent.

Examples of the hydrophobizing agent include known organic silicon compounds including an alkyl group, such as a methyl group, an ethyl group, a propyl group, or a butyl group. Specific examples thereof include an alkoxysilane compound, a siloxane compound, and a silazane compound. Among these, at least one of the siloxane compound and the silazane compound is preferably included in the hydrophobizing agent. The hydrophobizing agents may be used alone or in combination of two or more.

Examples of the siloxane compound include a silicone oil and a silicone resin. The silicone oil may include a dimethyl silicone oil. The above siloxane compounds may be used alone or in combination of two or more.

Examples of the silazane compound include hexamethyldisilazane and tetramethyldisilazane. In particular, hexamethyldisilazane (HMDS) is preferably included in the silazane compound. The above silazane compounds may be used alone or in combination of two or more.

The amount of the hydrophobizing agent, such as the silazane compound, deposited on the surfaces of the first silica particles is preferably 0.01% by mass or more and 5% by mass or less, is more preferably 0.05% by mass or more and 3% by mass or less, and is further preferably 0.10% by mass or more and 2% by mass or less of the amount of the first silica particles in order to increase the degree of hydrophobicity of the first silica particles.

For performing the hydrophobic treatment of the first silica particles with the hydrophobizing agent, for example, the following methods may be used: a method in which the hydrophobizing agent is dissolved in supercritical carbon dioxide and thereby applied to the surfaces of the silica particles; a method in which a solution containing the hydrophobizing agent and a solvent in which the hydrophobizing agent is soluble is applied to the surfaces of the silica particles by spraying, coating, or the like in the atmosphere in order to apply the hydrophobizing agent onto the surfaces of the silica particles; and a method in which a solution containing the hydrophobizing agent and a solvent in which the hydrophobizing agent is soluble is added to a silica particle dispersion liquid in the atmosphere and, after holding has been performed, the mixed solution of the silica particle dispersion liquid and the above solution is dried.

Other External Additive

The toner used in the exemplary embodiment may further include an external additive other than the first silica particles. Hereinafter, such an external additive is referred to simply as "another external additive". Examples of the other external additive include inorganic oxide particles. Examples of the inorganic oxide particles include $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, $CaO.SiO_2$ particles, $K_2O.(TiO_2)_n$ particles, $Al_2O_3.2SiO_2$ particles, $CaCO_3$ particles, $MgCO_3$ particles, $BaSO_4$ particles, and $MgSO_4$ particles. Among the above inorganic oxide particles, $TiO_2$ and $SiO_2$ particles, that is, titania particles and silica particles (hereinafter, referred to as "second silica particles"), are preferably used.

The number average particle size of the inorganic oxide particles is preferably 9 nm or more and 50 nm or less, is more preferably 10 nm or more and 40 nm or less, and is further preferably 10 nm or more and 30 nm or less in order to enhance the flowability of the toner.

The number average particle size of the inorganic oxide particles are determined in the following manner.

(1) The toner is dispersed in methanol. After the resulting dispersion liquid has been stirred at room temperature (23° C.), the dispersion liquid is subjected to an ultrasonic bath in order to separate the external additive from the toner. Subsequently, centrifugal separation is performed to precipitate toner particles and collect a dispersion liquid containing the external additive dispersed therein. Then, methanol is removed by distillation and the external additive is extracted.

(2) The external additive is dispersed on the surface of the resin particle having a volume average particle size of 100 μm (polyester particles, weight average molecular weight Mw: 50,000).

(3) The resin particle on which the external additive is dispersed is observed with a scanning electron microscope (SEM) "S-4800" produced by Hitachi High-Technologies Corporation equipped with an energy dispersive X-ray (EDX) analyzer "EMAX Evolution X-Max 80=2" produced by HORIBA, Ltd. An image of the external additive is taken at a 40,000-fold magnification. Then, by EDX analysis, on the basis of the presence of the atoms (e.g., Si and Ti) included in the inorganic oxide particles, 300 or more primary particles of the inorganic oxide particles are identified in one field of view. The SEM observation is conducted with an accelerating voltage of 15 kV, an emission current of 20 μA, and a working distance (WD) of 15 mm. The EDX analysis is conducted under the same conditions as above for a detection time of 60 minutes.

(4) The resulting image is captured into an image processor "LUZEXIII" produced by NIRECO CORPORATION. The area of each particle is measured by image analysis.

(5) The size of each inorganic oxide particle is calculated on the basis of the area calculated above in terms of equivalent circle diameter.

(6) 100 particles having an equivalent circle diameter of less than 80 nm are selected. For the selected particles, a cumulative distribution curve is drawn in ascending order in terms of equivalent circle diameter. The particle size at which the cumulative number reaches 50% is considered the number average particle size of the inorganic oxide particles.

The content of the inorganic oxide particles in the toner may be lower than the content of the first silica particles in the toner in order to reduce the occurrence of image defects in the images formed with the image forming apparatus. Specifically, the amount of the inorganic oxide particles included in the toner is preferably 20 parts by mass or more and 80 parts by mass or less and is more preferably 30 parts by mass or more and 70 parts by mass or less relative to 100 parts by mass of the amount of the first silica particles included in the toner.

The ratio Da/Db of the number average particle size Da (nm) of the first silica particles to the number average particle size Db (nm) of the inorganic oxide particles is preferably 2.0 or more and 20 or less, is more preferably 2.1 or more and 32 or less, and is further preferably 2.2 or more and 30 or less in order to reduce the occurrence of image defects in the images formed with the image forming apparatus.

The surfaces of the inorganic oxide particles used as an external additive may be subjected to a hydrophobic treatment. The hydrophobic treatment is performed by, for example, immersing the inorganic oxide particles in a hydrophobizing agent. Examples of the hydrophobizing agent include, but are not limited to, a silane coupling agent, a silicone oil, a titanate coupling agent, and aluminum coupling agent. These hydrophobizing agents may be used alone or in combination of two or more.

The amount of the hydrophobizing agent is commonly, for example, 1 part by mass or more and 10 parts by mass or less relative to 100 parts by mass of the inorganic oxide particles.

Examples of the external additive particles include particles of a resin, such as polystyrene, polymethyl methacrylate (PMMA), or a melamine resin; and particles of a cleaning lubricant, such as a fluorine-contained resin.

The amount of the other external additive used is preferably, for example, 0.01% by mass or more and 5% by mass or less and is more preferably 0.01% by mass or more and 2.0% by mass or less of the amount of the toner particles.

Method for Producing Toner

A method for producing the toner used in the exemplary embodiment is described below.

The toner used in the exemplary embodiment is produced by, after the preparation of the toner particles, depositing an external additive on the surfaces of the toner particles.

The toner particles may be prepared by any dry process, such as knead pulverization, or any wet process, such as aggregation coalescence, suspension polymerization, or dissolution suspension. However, a method for preparing the toner particles is not limited thereto, and any suitable method known in the related art may be used.

The toner used in the exemplary embodiment is produced by, for example, adding an external additive to the dried toner particles and mixing the resulting toner particles using a V-blender, a HENSCHEL mixer, a Lodige mixer, or the like. Optionally, coarse toner particles may be removed using a vibrating screen classifier, a wind screen classifier, or the like.

Carrier

The type of the carrier is not limited, and any suitable carrier known in the related art may be used. Examples of the carrier include a coated carrier prepared by coating the surfaces of cores including magnetic powder particles with a coat resin; a magnetic-powder-dispersed carrier prepared by dispersing and mixing magnetic powder particles in a matrix resin; and a resin impregnated carrier prepared by impregnating a porous magnetic powder with a resin.

The magnetic-powder-dispersed carrier and the resin impregnated carrier may also be prepared by coating the surfaces of particles constituting the carrier, that is, core particles, with a coat resin.

Examples of the magnetic powder include powders of magnetic metals, such as iron, nickel, and cobalt; and powders of magnetic oxides, such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid ester copolymer, a straight silicone resin including an organosiloxane bond and the modified products thereof, a fluorine resin, polyester, polycarbonate, a phenolic resin, and an epoxy resin. The coat resin and the matrix resin may optionally include additives, such as conductive particles.

Examples of the conductive particles include particles of metals, such as gold, silver, and copper; and particles of carbon black, titanium oxide, zinc oxide, tin oxide, barium sulfate, aluminum borate, and potassium titanate.

The surfaces of the cores can be coated with a coat resin by, for example, using a coating layer forming solution prepared by dissolving the coat resin and, as needed, various types of additives in a suitable solvent. The type of the solvent is not limited and may be selected with consideration of the type of the coat resin used, ease of applying the coating layer forming solution, and the like. Specific examples of a method for coating the surfaces of the cores with the coat resin include an immersion method in which the cores are immersed in the coating layer forming solution; a spray method in which the coating layer forming solution is sprayed onto the surfaces of the cores; a fluidized bed method in which the coating layer forming solution is sprayed onto the surfaces of the cores while the cores are floated using flowing air; and a kneader coater method in which the cores of the carrier are mixed with the coating layer forming solution in a kneader coater and subsequently the solvent is removed.

The mixing ratio (i.e., mass ratio) of the toner to the carrier in the two-component developer is preferably toner: carrier=1:100 to 30:100 and is more preferably 3:100 to 20:100.

Process Cartridge

A process cartridge according to the exemplary embodiment is described below.

The process cartridge according to exemplary embodiment is a process cartridge detachably attachable to an image forming apparatus, the process cartridge including a developing unit that includes an electrostatic image developer including an electrostatic image developing toner and develops an electrostatic image formed on the surface of the image holding member with the electrostatic image developer to form an electrostatic image developing toner image; and a cleaning unit that removes toner particles that remain on the image holding member. The cleaning unit includes a unit A that includes a cleaning blade arranged to contact with the surface of the image holding member. A portion of the cleaning blade which contacts with the image holding member has a JIS-A hardness of 90° or more. In another case, the cleaning unit includes a unit B that includes a cleaning blade arranged to contact with the surface of the image holding member and controls a load with which the cleaning blade contacts with the image holding member in a constant load mode. The electrostatic image developing toner includes toner particles; and silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more.

The structures of the electrostatic image developing toner, the electrostatic image developer, the developing unit, and the cleaning unit included in the process cartridge according to the exemplary embodiment are the same as those of the electrostatic image developing toner, the electrostatic image developer, the developing unit, and the cleaning unit included in the image forming apparatus according to the exemplary embodiment, respectively.

The process cartridge according to the exemplary embodiment may optionally further include at least one selected from the image holding member, the charging unit, the latent image forming unit, the transfer unit, and the like.

The structures of the image holding member, the charging unit, the latent image forming unit, the transfer unit, and the like are also the same as those of the image holding member, the charging unit, the latent image forming unit, the transfer unit, and the like of the image forming apparatus according to the exemplary embodiment, respectively.

EXAMPLES

Examples of the exemplary embodiment of the present disclosure are described below. The exemplary embodiment of the present disclosure is not limited to Examples below. Hereinafter, the terms "part" and "%" are all on a mass basis unless otherwise specified.

Preparation of First Silica Particles

Preparation of Silica Particle Dispersion Liquid (1)

To a glass reaction container equipped with a stirrer, a dropping nozzle, and a thermometer, 300 parts of methanol and 70 parts of 10% ammonia water are added. The resulting mixture is stirred to form an alkali catalyst solution. After the temperature of the alkali catalyst solution has been adjusted to be 30° C. (hereinafter, referred to as "addition start temperature"), 185 parts of tetramethoxysilane and 50 parts of 8% ammonia water are simultaneously added dropwise to the alkali catalyst solution while stirring is performed. Hereby, a hydrophilic silica particle dispersion liquid (solid content: 12%) is prepared. The amount of time during which tetramethoxysilane and ammonia water are added dropwise to the alkali catalyst solution (hereinafter, referred to as "addition time") is 30 minutes. The silica particle dispersion liquid is concentrated to have a solid content of 40% with a rotary filter "R-Fine" produced by Kotobuki Industries Co., Ltd. This concentrated dispersion liquid is used as a silica particle dispersion liquid (1).

Preparation of Silica Particle Dispersion Liquids (2) to (8) and (c1) to (c6)

Silica particle dispersion liquids (2) to (8) and (c1) to (c6) are prepared as in the preparation of the silica particle dispersion liquid (1), except that the conditions of the alkali catalyst solution (i.e., the content of the methanol, the concentration and content of the ammonia water) and the conditions under which the silica particles are formed (i.e., the amount of tetramethoxysilane (TMOS) added to the alkali catalyst solution, the concentration of the ammonia water, the total amount of the ammonia water added, the addition time of the TMOS and the ammonia water, and the addition start temperature of the TMOS and the ammonia water) are changed as described in Table 1.

Preparation of Surface Treated Silica Particles (S1)

Using the silica particle dispersion liquid (1), the surfaces of silica particles are treated with a siloxane compound in a supercritical carbon dioxide atmosphere in the following manner. The surface treatment is performed using an apparatus equipped with a carbon dioxide cylinder, a carbon dioxide pump, an entrainer pump, an autoclave with a stirrer (capacity: 500 ml), and a pressure valve.

First, 300 parts of the silica particle dispersion liquid (1) is charged into the autoclave with a stirrer (capacity: 500 ml), and the stirrer is rotated at 100 revolutions per minute (rpm). Subsequently, liquid carbon dioxide is injected into the autoclave. While the temperature is increased with a heater, the pressure is increased with the carbon dioxide pump to bring the inside of the autoclave into a supercritical state of 150° C. and 15 MPa. Subsequently, while the pressure inside the autoclave is maintained to be 15 MPa with the pressure valve, supercritical carbon dioxide is passed through the autoclave with the carbon dioxide pump in order to remove methanol and water from the silica particle dispersion liquid (1) (solvent removal step). Hereby, silica particles (i.e., untreated silica particles) are prepared.

The flow of supercritical carbon dioxide is stopped when the amount of the supercritical carbon dioxide passed (cumulative amount; in terms of the amount of carbon dioxide in the standard condition) reaches 900 parts.

Then, while the temperature is maintained to be 150° C. with a heater and the pressure is maintained to be 15 MPa with the carbon dioxide pump in order to maintain the supercritical state of carbon dioxide inside the autoclave, a treatment agent solution prepared by dissolving 0.3 parts of a dimethyl silicone oil (DSO) "KF-96" produced by Shin-Etsu Chemical Co., Ltd. having a viscosity of 10,000 cSt, which is a siloxane compound, in 20 parts of hexamethyldisilazane (HMDS) produced by Yuki Gosei Kogyo Co., Ltd., which is a hydrophobizing agent, relative to 100 parts of the silica particles (i.e., untreated silica particles) is injected into the autoclave with the entrainer pump. While the resulting mixture is stirred, the mixture is caused to react at 180° C. for 20 minutes. Subsequently, supercritical carbon dioxide is again passed through the autocrave to remove excess treatment agent solution. Subsequently, the stirring is stopped. The pressure valve is opened to reduce the pressure inside the autoclave to atmospheric pressure. The temperature is reduced to room temperature (25° C.).

In the above-described manner, the solvent removal step and the surface treatment using HMDS and DSO are performed to prepare surface treated silica particles (S1).

Preparation of Surface Treated Silica Particles (S2) to (S8) and (cS1) to (cS6)

Surface treated silica particles (S2) to (S8) and (cS1) to (cS6) are prepared as in the preparation of the surface treated silica particles (S1).

Preparation of Surface Treated Silica Particles (cS7)

Surface treated silica particles (cS7) are prepared as described in Paragraphs [0051] to [0053] of Japanese Laid Open Patent Application Publication No. 2008-174430.

Preparation of Surface Treated Silica Particles (cS8)

Surface treated silica particles (cS8) are prepared as described in Paragraph [0019] of Japanese Laid Open Patent Application Publication No. 2001-194824.

TABLE 1

| | | | | Silica particle formation conditions | | | | |
|---|---|---|---|---|---|---|---|---|
| | Alkali catalyst solution | | | Total amount of TMOS | Ammonia water | | | Addition start |
| | | Ammonia water | | | | Total amount | Addition | |
| Silica particles | Methanol (part) | Concentration (%) | Amount (part) | added (part) | Concentration (%) | added (part) | time (minute) | temperature (° C.) |
| S1 | 300 | 10 | 70 | 185 | 8 | 50 | 30 | 30 |
| S2 | 300 | 10 | 70 | 185 | 8 | 50 | 30 | 35 |
| S3 | 300 | 10 | 70 | 185 | 8 | 45 | 30 | 30 |
| S4 | 300 | 10 | 75 | 185 | 8 | 50 | 30 | 30 |
| S5 | 300 | 10 | 65 | 185 | 8 | 50 | 50 | 30 |
| S6 | 300 | 10 | 65 | 170 | 8 | 50 | 20 | 30 |
| S7 | 300 | 10 | 70 | 247 | 8 | 67 | 55 | 40 |
| S8 | 300 | 10 | 70 | 123 | 8 | 30 | 18 | 30 |
| cS1 | 300 | 10 | 70 | 185 | 8 | 50 | 30 | 45 |
| c52 | 300 | 10 | 50 | 185 | 8 | 50 | 30 | 20 |
| c53 | 300 | 10 | 110 | 185 | 8 | 50 | 30 | 30 |
| c54 | 300 | 10 | 46 | 120 | 8 | 30 | 30 | 30 |
| c55 | 300 | 10 | 70 | 340 | 8 | 92 | 55 | 30 |
| c56 | 300 | 10 | 70 | 120 | 8 | 30 | 20 | 30 |

Preparation of Polyester Resin Particle Dispersion Liquids

Preparation of Amorphous Polyester Resin Particle Dispersion Liquid (A1)

Terephthalic acid: 70 parts

Fumaric acid: 30 parts

Ethylene glycol: 45 parts 1,5-Pentanediol: 46 parts

Into a flask equipped with a stirring device, a nitrogen introducing tube, a temperature sensor, and a fractionating column, the above materials are charged. Under a nitrogen stream, the temperature is increased to 220° C. over 1 hour, and 1 part of titanium tetraethoxide relative to 100 parts of the total amount of the above materials is added to the flask. While the product water is removed by distillation, the temperature is increased to 240° C. over 0.5 hours and dehydration condensation is continued for 1 hour at 240° C. Subsequently, the product of the reaction is cooled. Hereby, a polyester resin having a weight average molecular weight of 9,500 and a glass transition temperature of 62° C. is synthesized.

Into a container equipped with a temperature controller and a nitrogen purging unit, 40 parts of ethyl acetate and 25 parts of 2-butanol are charged to form a mixed solvent. To the mixed solvent, 100 parts of a polyester resin is gradually added and dissolved in the mixed solvent. To the resulting solution, a 10% aqueous ammonia solution is added in an amount 3 times by mole with respect to the acid value of the resin. The resulting mixture is stirred for 30 minutes. Then, the inside of the container is purged with dry nitrogen. While the temperature is maintained to be 40° C. and the liquid mixture is stirred, 400 parts of ion-exchange water is added dropwise to the container at a rate of 2 part/min in order to perform emulsification. After the addition of ion-exchange water has been terminated, the resulting emulsion is cooled to 25° C. Hereby, a resin particle dispersion liquid that includes resin particles having a volume average particle size of 200 nm dispersed therein is prepared. Ion-exchange water is added to the resin particle dispersion liquid to adjust the solid content in the dispersion liquid to be 20%. Hereby, an amorphous polyester resin particle dispersion liquid (A1) is prepared.

Preparation of Crystalline Polyester Resin Particle Dispersion Liquid (C1)

1,10-Decanedicarboxylic acid: 98 parts
Sodium dimethyl-5-sulfonate isophthalate: 24 parts
1,9-Nonanediol: 100 parts
Dibutyltin oxide (catalyst): 0.3 parts The above components are charged into a three-necked flask dried by heating. Subsequently, the pressure is reduced to replace the atmosphere inside the container with an inert atmosphere with a nitrogen gas. The resulting mixture is stirred by mechanical stirring and caused to reflux at 180° C. for 5 hours. Then, the temperature is gradually increased to 230° C. under reduced pressure and stirring is performed for 2 hours. When the mixture becomes viscous, air cooling is performed and the reaction is stopped. Hereby, a crystalline polyester resin is prepared. The weight average molecular weight (Mw) of the crystalline polyester resin measured in terms of polystyrene is 9,700. The crystalline polyester resin has a melting temperature of 78° C.

Then, 90 parts of the crystalline polyester resin, 1.8 parts of an anionic surfactant "NEOGEN RK" produced by DKS Co. Ltd., and 210 parts of ion-exchange water are heated to 100° C. and dispersed with ULTRA-TURRAX T50 produced by IKA. Subsequently, a dispersion treatment is performed for 1 hour using a pressure-discharge Gaulin homogenizer. Hereby, a crystalline polyester resin particle dispersion liquid (C1) having a volume average particle size of 200 nm and a solid content of 20% is prepared.

Preparation of Styrene Acrylic Resin Particle Dispersion Liquid

Preparation of Styrene Acrylic Resin Particle Dispersion Liquid (B1)

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1 part A solution prepared by dissolving 4 parts of an anionic surfactant "DOWFAX" produced by The Dow Chemical Company in 550 parts of ion-exchange water is charged into a flask. A liquid mixture prepared by mixing the above raw materials is charged into the flask to form an emulsion. While the emulsion is stirred slowly for 10 minutes, 50 parts of ion-exchange water in which 6 parts of ammonium persulfate has been dissolved is charged into the flask. Subsequently, the inside of the system is purged with nitrogen to a sufficient degree. Then, the temperature inside the system is increased to 75° C. using an oil bath. Polymerization is performed for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 2 parts A liquid mixture prepared by mixing the above raw materials is emulsified. The resulting emulsion is added to the above flask over 120 minutes, and emulsion polymerization is continued for 4 hours while the emulsion is added to the flask. Hereby, a resin particle dispersion liquid that includes resin particles having a weight average molecular weight of 32,000, a glass transition temperature of 53° C., and a volume average particle size of 240 nm dispersed therein is prepared. Ion-exchange water is added to the resin particle dispersion liquid to adjust the solid content to be 20%. Hereby, a styrene acrylic resin particle dispersion liquid (B1) is prepared.

Preparation of Release Agent Particle Dispersion Liquid

Paraffin wax "HNP-9" produced by Nippon Seiro Co., Ltd.: 100 parts
Anionic surfactant "NEOGEN RK" produced by Dai-ichi Kogyo Seiyaku Co., Ltd.: 1 part
Ion-exchange water: 350 parts The above materials are mixed with one another and heated to 100° C. The resulting mixture is dispersed with a homogenizer "ULTRA-TURRAX T50" produced by IKA and then further dispersed with a Manton Gaulin high-pressure homogenizer produced by Gaulin. Hereby, a release agent particle dispersion liquid (solid content: 20%) in which release agent particles having a volume average particle size of 200 nm are dispersed is prepared.

Preparation of Black Particle Dispersion Liquid

Carbon black "REGAL330" produced by Cabot Corporation: 50 parts
Anionic surfactant "NEOGEN RK" produced by DKS Co. Ltd.: 5 parts
Ion-exchange water: 192.9 parts The above components are mixed with one another, and the resulting mixture is subjected to ULTIMIZER produced by Sugino Machine Limited at 240 MPa for 10 minutes. Hereby, a black particle dispersion liquid (solid content: 20%) is prepared.

Preparation of Toner Particles (A1)

Ion-exchange water: 200 parts
Amorphous polyester resin particle dispersion liquid (A1): 150 parts
Crystalline polyester resin particle dispersion liquid (C1): 10 parts
Black particle dispersion liquid: 15 parts
Release agent particle dispersion liquid: 10 parts
Anionic surfactant (TAYCAPOWER): 2.8 parts The above materials are charged into a round-bottom flask made of stainless steel. After pH has been adjusted to be 3.5 by addition of 0.1 N nitric acid, an aqueous polyaluminum chloride (PAC) solution prepared by dissolving 2.0 parts of PAC (30% powder produced by Oji Paper Co., Ltd.) in 30 parts of ion-exchange water is added to the flask. After dispersion has been performed with a homogenizer "ULTRA-TURRAX T50" produced by IKA at 30° C., the temperature is increased to 45° C. in a heating oil bath. Then, holding is performed until the volume average particle size reaches 4.8 μm. Subsequently, 60 parts of the amorphous polyester resin particle dispersion liquid (A1) is added to the flask and holding is performed for 30 minutes. When the volume average particle size reaches 5.2 μm, another 60 parts of the amorphous polyester resin particle dispersion liquid (A1) is added to the flask and holding is performed for 30 minutes. Then, 20 parts of a 10% aqueous solution of nitrilotriacetic acid (NTA) metal salt "CHELEST 70" produced by Chelest Corporation is added to the flask. Subsequently, the pH is adjusted to be 9.0 using a 1 N aqueous sodium hydroxide solution. Then, 1.0 parts of an anion activator "TAYCAPOWER" is added to the flask. While stirring is continued, the temperature is increased to 85° C. and then holding is performed for 5 hours. Subsequently, the temperature is reduced to 20° C. at a rate of 20° C./min. Then, filtration is performed. The resulting substance is sufficiently washed with ion-exchange water and dried to form toner particles (A1) having a volume average particle size of 6.0 μm.

Preparation of Toner Particles (B1)

Ion-exchange water: 400 parts

Styrene acrylic resin particle dispersion liquid (B1): 200 parts

Black particle dispersion liquid: 40 parts

Release agent particle dispersion liquid: 12 parts

The above components are charged into a reaction container equipped with a thermometer, a pH meter, and a stirrer. While the temperature is controlled with a heating mantle from the outside, holding is performed for 30 minutes at 30° C. and a rotation speed of 150 rpm. While dispersion is performed with a homogenizer "ULTRA-TURRAX T50" produced by IKA Japan K.K., an aqueous polyaluminum chloride (PAC) solution prepared by dissolving 2.1 parts of PAC (30% powder) produced by Oji Paper Co., Ltd. in 100 parts of ion-exchange water is added to the reactor. Subsequently, the temperature is increased to 50° C. The size of the resulting particles is measured with COULTER MULTISIZER II (aperture diameter: 50 μm) produced by Beckman Coulter, Inc. The volume average particle size is adjusted to be 5.0 μm. Subsequently, 115 parts of the resin particle dispersion liquid (B1) is further added to the container to deposit resin particles on the surface of the aggregated particles (shell structure). Then, 20 parts of a 10% aqueous solution of nitrilotriacetic acid (NTA) metal salt "CHELEST 70" produced by Chelest Corporation is added to the container. Subsequently, the pH is adjusted to be 9.0 using a 1 N aqueous sodium hydroxide solution. Then, the temperature is increased to 91° C. at a heating rate of 0.05° C./min. After holding has been performed at 91° C. for 3 hours, the resulting toner slurry is cooled to 85° C. and then holding is performed for 1 hour. Subsequently, the temperature is reduced to 25° C. Hereby, a magenta toner is prepared. The toner is again dispersed in ion-exchange water, and the dispersion liquid is filtered. By repeating the above cycle, cleaning is performed until the electric conductivity of the filtrate reaches 20 μS/cm or less. Subsequently, vacuum drying is performed for 5 hours in an oven heated at 40° C. Hereby, toner particles (B1) are prepared.

Preparation of Toner (A1)

With 100 parts of the toner particles (A1), 1.5 parts of the first silica particles (S1) and 0.5 parts of titania particles having a number average particle size of 20 nm, which are inorganic oxide particles, are mixed. The resulting mixture is stirred with a sample mill at a rotation speed of 13,000 rpm for 30 seconds. Then, screening is performed with a vibration sieve having an opening of 45 μm. Hereby, a toner (A1) is prepared.

Preparation of Toners (A2) to (A8) and (cA1) to (cA8)

Toners (A2) to (A8) and (cA1) to (cA8) are prepared as in the preparation of toner (A1), except that the type of the first silica particles used is changed as described in Table 2.

Preparation of Developers (A1) to (A8) and (cA1) to (cA8)

Into a V-blender, 10 parts of a specific one of the toners and 100 parts of the resin-coated carrier particles described below are charged. The resulting mixture is stirred for 20 minutes and then screened through a vibration sieve having an opening of 212 μm to form a developer.

Mn—Mg—Sr ferrite particles (average particle size: 40 μm): 100 parts

Toluene: 14 parts

Polymethyl methacrylate: 2 parts

Carbon black "VXC72" produced by Cabot Corporation: 0.12 parts

The above materials except the ferrite particles are mixed with glass beads (diameter 1 mm, in an amount equal to that of the toluene used). The resulting mixture is stirred with a sand mill produced by Kansai Paint Co., Ltd. at a rotation speed of 1,200 rpm for 30 minutes to form a dispersion liquid. The dispersion liquid and the ferrite particles are charged into a vacuum degassing kneader. While the resulting mixture is stirred, the pressure is reduced and drying is performed. Hereby, resin-coated carrier particles are prepared.

TABLE 2

| | | First silica particles | | | | | | |
|---|---|---|---|---|---|---|---|---|
| Toner particles | Developer | Type | Average circularity | Number average particle size Da (nm) | Upper GSDp | Lower GSDp | Proportion of silica particles having circularity of 0.92 or more (number %) | Degree of hydrophobicity (%) |
| cA1 | cA1 | cS1 | 0.958 | 120 | 1.090 | 1.041 | 85 | 64 |
| cA2 | cA2 | cS2 | 0.945 | 120 | 1.071 | 1.074 | 72 | 64 |
| cA3 | cA3 | cS3 | 0.981 | 120 | 1.022 | 1.028 | 95 | 64 |
| cA4 | cA4 | cS4 | 0.928 | 120 | 1.068 | 1.055 | 89 | 64 |
| cA5 | cA5 | cS5 | 0.958 | 140 | 1.029 | 1.033 | 94 | 64 |
| cA6 | cA6 | cS6 | 0.958 | 100 | 1.059 | 1.055 | 88 | 64 |
| cA7 | cA7 | cS7 | 0.950 | 120 | 1.072 | 1.049 | 72 | 64 |
| cA8 | cA8 | cS8 | 0.942 | 115 | 1.093 | 1.037 | 82 | 58 |
| A1 | A1 | S1 | 0.958 | 120 | 1.058 | 1.042 | 90 | 64 |
| A2 | A2 | S2 | 0.958 | 120 | 1.077 | 1.071 | 87 | 64 |
| A3 | A3 | S3 | 0.958 | 120 | 1.065 | 1.081 | 88 | 64 |

TABLE 2-continued

| Toner particles | Developer | First silica particles Type | Average circularity | Number average particle size Da (nm) | Upper GSDp | Lower GSDp | Proportion of silica particles having circularity of 0.92 or more (number %) | Degree of hydrophobicity (%) |
|---|---|---|---|---|---|---|---|---|
| A4 | A4 | S4 | 0.974 | 120 | 1.025 | 1.028 | 94 | 64 |
| AS | AS | S5 | 0.941 | 120 | 1.032 | 1.066 | 90 | 64 |
| A6 | A6 | S6 | 0.958 | 120 | 1.046 | 1.039 | 84 | 64 |
| A7 | A7 | S7 | 0.964 | 128 | 1.068 | 1.060 | 98 | 64 |
| A8 | A8 | S8 | 0.950 | 112 | 1.061 | 1.074 | 89 | 64 |

Preparation of Image Holding Member A1

Formation of Undercoat Layer

With 100 parts by mass of zinc oxide (average particle size: 70 nm, specific surface area: 15 $m^2/g$) produced by TAYCA CORPORATION, 500 parts by mass of toluene is mixed while stirring is performed. To the resulting mixture, 1.3 parts by mass of a silane coupling agent "KBM503" produced by Shin-Etsu Chemical Co., Ltd. is added. The resulting mixture is stirred for 2 hours. Subsequently, toluene is removed by reduced-pressure distillation. Then, burning is performed at 120° C. for 3 hours. Hereby, zinc oxide particles surface-treated with a silane coupling agent are prepared. With 110 parts by mass of the surface-treated zinc oxide particles, 500 parts by mass of tetrahydrofuran is mixed while stirring is performed. To the resulting mixture, a solution prepared by dissolving 0.6 parts by mass of alizarin in 50 parts by mass of tetrahydrofuran is added. The mixture is stirred at 50° C. for 5 hours. Subsequently, zinc oxide particles on which alizarin is deposited are separated by filtration under reduced pressure. Furthermore, drying is performed at 60° C. under reduced pressure. Hereby, zinc oxide particles on which alizarin is deposited are prepared.

With 38 parts by mass of a liquid mixture prepared by mixing 60 parts by mass of the zinc oxide particles on which alizarin is deposited, 13.5 parts by mass of a curing agent that is a blocked isocyanate "SUMIDUR 3175" produced by Sumitomo Bayer Urethane Co., Ltd., and 15 parts by mass of a butyral resin "S-LEC BM-1" produced by SEKISUI CHEMICAL CO., LTD. with 85 parts by mass of methyl ethyl ketone, 25 parts by mass of methyl ethyl ketone is mixed. The resulting mixture is dispersed for 2 hours using a sand mill with glass beads having a diameter of 1 mm to form a dispersion liquid. To the dispersion liquid, 0.005 parts by mass of dioctyltin dilaurate used as a catalyst and 40 parts by mass of silicone resin particles "TOSPEARL 145" produced by Momentive Performance Materials Inc. are added. Hereby, an undercoat layer forming coating liquid is prepared. The undercoat layer forming coating liquid is applied to an aluminum substrate by dip coating. The resulting coating film is dried to cure at 170° C. for 40 minutes to form an undercoat layer having a thickness of 20 μm.

Formation of Charge Generation Layer

A mixture of 15 parts by mass of hydroxygallium phthalocyanine (CGM-1) used as a charge generating material which has diffraction peaks at Bragg angles (20±0.2°) of at least 7.3°, 16.0°, 24.9°, and 28.0° in a X-ray diffraction spectrum prepared using Cuka X-ray, 10 parts by mass of a vinyl chloride-vinyl acetate copolymer resin "VMCH" produced by Nippon Unicar Company Limited which is used as a binder resin, and 200 parts by mass of n-butyl acetate is dispersed for 4 hours using a sand mill with glass beads having a diameter of 1 mm. To the dispersion liquid, 175 parts by mass of n-butyl acetate and 180 parts by mass of methyl ethyl ketone are added. The resulting mixture is stirred to form a charge generation layer forming coating liquid. The charge generation layer forming coating liquid is applied to the undercoat layer by dip coating. The resulting coating film is dried at room temperature (25° C.) to form a charge generation layer having a thickness of 0.2 μm.

Formation of Charge Transport Layer

To 100 parts by mass of untreated (hydrophilic) silica particles "OX50" produced by AEROSIL (volume average particle size: 40 nm), 30 parts by mass of a trimethylsilane compound (1,1,1,3,3,3-hexamethyldisilazane produced by Tokyo Chemical Industry Co., Ltd.) used as a hydrophobizing agent is added. After the reaction has been conducted for 24 hours, a filtration residue is taken. Hereby, hydrophobized silica particles are prepared. The hydrophobized silica particles are used as silica particles (1). The condensation ratio of the silica particles (1) is 93%.

With 50 parts by mass of the silica particles (1), 250 parts by mass of tetrahydrofuran is mixed. While the liquid temperature is maintained to be 20° C., 25 parts by mass of 4-(2,2-diphenylethyl)-4',4"-dimethyl-triphenylamine used as a charge transporting material and 25 parts by mass of a bisphenol-Z polycarbonate resin (viscosity average molecular weight: 30,000) used as a binder resin are added to the resulting mixture. The mixture is stirred for 12 hours to form a charge transport layer forming coating liquid.

The charge transport layer forming coating liquid is applied to the charge generation layer. The resulting coating film is dried at 135° C. for 40 minutes to form a charge transport layer having a thickness of 30 μm. Hereby, an image holding member is prepared.

Formation of Protection Layer

A protection layer forming coating liquid is prepared by mixing 30 parts by mass of the compound (A-4) described below, which is used as a charge transporting material, 0.2 parts by mass of colloidal silica "PL-1" produced by Fuso Chemical Co., Ltd., 30 parts by mass of toluene, 0.1 parts by mass of 3,5-di-t-butyl-4-hydroxytoluene (BHT), 0.1 parts by mass of azoisobutyronitrile (10-hour half-life temperature: 65° C.), and "V-30" produced by FUJIFILM Wako Pure Chemical Corporation (10-hour half-life temperature: 104° C.). The coating liquid is applied to the charge transport layer by spray coating. The resulting coating film is air-dried at room temperature (25° C.) for 30 minutes. Subsequently, the coating film is heated from room temperature to 150° C. over 30 minutes in a stream of nitrogen at an oxygen concentration of 110 ppm. The coating film is further heated at 150° C. for 30 minutes to cure. Hereby, a protection layer having a thickness of 10 μm is formed. The universal hardness of the protection layer which is measured by the above-described measuring method is 200 N/mm$^2$. An image holding member A1 is prepared in the above-described manner.

member A1 and the cleaning blade described in Table 3 are attached to the image forming apparatus. The angle (contact angle) θ formed by the cleaning blade and the image holding member is set to 11°. The pressing force N at which the cleaning blade is pressed against the image holding member is set to 2.5 gf/mm$^2$. The pressing force is controlled in a constant load mode.

(A-4)

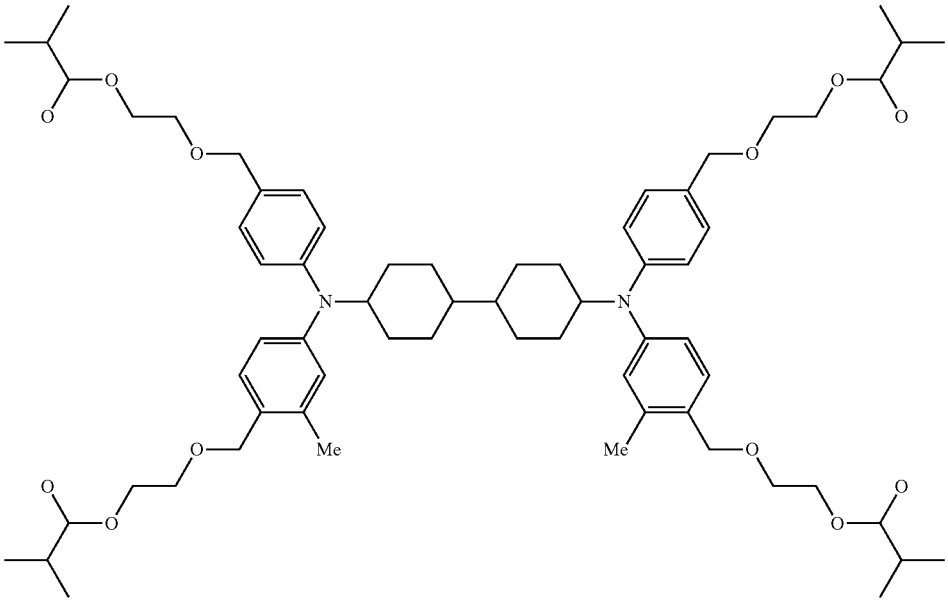

Preparation of Cleaning Unit C1

A urethane resin having a JIS-A hardness of 80° is formed into a shape with a centrifugal molding machine to form a low-hardness material layer. Subsequently, a urethane resin having a JIS-A hardness of 90° is formed into a shape by centrifugal molding to form a high-hardness material layer on the low-hardness material layer. Hereby, a cleaning blade is prepared.

The cleaning blade is constituted by a layer having a JIS-A hardness of 90° or more, which is to contact with the image holding member, and a layer having a lower hardness than the layer having a JIS-A hardness of 90° or more. The distance between the portion of the cleaning blade at which the cleaning blade is fixed and the edge of the cleaning blade is 7.5 mm. The maximum and minimum thicknesses of the cleaning blade are 1.8 mm and 0.7 mm. The thickness of the layer having a JIS-A hardness of 90° or more is 0.3 mm.

The JIS-A hardness of the layer having a JIS-A hardness of 90° or more is 90°. The JIS-A hardness of the layer having a lower hardness than the layer having a JIS-A hardness of 90° or more is 80°.

The cleaning blade is made to contact with the surface of the image holding member at an angle of 30° such that the depth of penetration of the cleaning blade is 0.8 mm. Hereby, a cleaning unit C1 is prepared.

Examples 1 to 8 and Comparative Examples 1 to 8

As an image forming apparatus, a modification of "Color 1000 Press" produced by Fuji Xerox Co., Ltd. is prepared. A specific one of the developers described in Table 3 is charged to the image forming apparatus. The image holding Evaluation Evaluation of Image Defects An image is formed on A4-size paper sheets with the above evaluation machine under the conditions 1 (high temperature, high humidity) or the conditions 2 (low temperature, low humidity). Subsequently, the surface of the image holding member is visually inspected to determine the occurrence of filming. An evaluation is made in accordance with the following evaluation criteria. Note that, the amount of image defects that occur under the above conditions corresponds to the degree of occurrence of filming.

Conditions 1

Temperature/humidity: 25° C./85%

Area coverage: 1%

Number of sheets printed: 10,000 sheets

Conditions 2

Temperature/humidity: 10° C./10%

Area coverage: 20%

Number of sheets printed: 10,000 sheets

Evaluation Criteria

A: Filming does not occur and no image defect occurs

B: Filming slightly occurs but does not impair image quality

C: Filming occurs and impairs mage quality to a certain degree

D: Filming frequently occurs and causes severe defects in image quality

TABLE 3

| | Developer | Silica particles | Image forming apparatus Cleaning unit | Evaluation Reduction in image defects High temperature, high humidity | Low temperature, low humidity |
|---|---|---|---|---|---|
| Example 1 | A1 | S1 | C1 | A | A |
| Example 2 | A2 | S2 | C1 | A | A |
| Example 3 | A3 | S3 | C1 | A | A |
| Example 4 | A4 | S4 | C1 | A | A |
| Example 5 | A5 | S5 | C1 | A | A |
| Example 6 | A6 | S6 | C1 | A | A |
| Example 7 | A7 | S7 | C1 | A | A |
| Example 8 | A8 | S8 | C1 | A | A |
| Comparative example 1 | cA1 | cS1 | C1 | D | D |
| Comparative example 2 | cA2 | cS2 | C1 | D | D |
| Comparative example 3 | cA3 | cS3 | C1 | D | D |
| Comparative example 4 | cA4 | cS4 | C1 | D | D |
| Comparative example 5 | cA5 | cS5 | C1 | D | D |
| Comparative example 6 | cA6 | cS6 | C1 | D | D |
| Comparative example 7 | cA7 | cS7 | C1 | D | D |
| Comparative example 8 | cA8 | cS8 | C1 | D | D |

As described in Table 3, the image forming apparatuses prepared in Examples reduce the occurrence of image defects in the images formed with the image forming apparatus compared with the image forming apparatuses prepared in Comparative examples.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit that charges a surface of the image holding member;

an electrostatic image forming unit that forms an electrostatic image on the charged surface of the image holding member;

a developing unit that includes an electrostatic image developer including a toner and develops the electrostatic image formed on the surface of the image holding member with the electrostatic image developer to form a toner image;

a transfer unit that transfers the toner image onto a surface of a recording medium; and a cleaning unit that removes toner particles present on the surface of the image holding member, the cleaning unit including a cleaning blade arranged to contact with the surface of the image holding member, and either the cleaning blade contains a contacting portion having a JIS-A hardness of 90° or more, or the cleaning unit includes a control unit that controls a load with which the cleaning blade contacts with the image holding member, the control unit controlling the load in a constant load mode, the toner including toner particles; and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more.

2. The image forming apparatus according to claim 1, wherein the silica particles have a large-diameter-side number particle size distribution index (upper GSDp) of 1.075 or less.

3. The image forming apparatus according to claim 1, wherein the silica particles have a small-diameter-side number particle size distribution index (lower GSDp) of 1.080 or less.

4. The image forming apparatus according to claim 1, wherein the silica particles have an average circularity of 0.95 to 0.97.

5. The image forming apparatus according to claim 1, wherein 85 number % or more of the silica particles have a circularity of 0.92 or more.

6. The image forming apparatus according to claim 1, wherein the cleaning blade includes a multilayer blade.

7. The image forming apparatus according to claim 6, wherein the cleaning blade includes a first layer having a JIS-A hardness of 90° or more and a second layer having a lower hardness than the first layer having a JIS-A hardness of 90° or more.

8. The image forming apparatus according to claim 7, wherein a difference in JIS-A hardness between the first layer of the cleaning blade, the first layer having a JIS-A hardness of 90° or more, and the second layer of the cleaning blade, the second layer having a lower hardness than the first layer, is 15° or more.

9. The image forming apparatus according to claim 1, wherein the cleaning blade that includes the contacting portion having a JIS-A hardness of 90° or more is produced by hardening the contacting portion.

10. The image forming apparatus according to claim 1, wherein the toner further includes inorganic oxide particles having a number average particle size of 5 nm or more and 50 nm or less.

11. The image forming apparatus according to claim 10, wherein the ratio Da/Db of the number average particle size Da of the silica particles to the number average particle size Db of the inorganic oxide particles is 2.5 to 20.

12. The image forming apparatus according to claim 1, wherein the toner particles include a styrene acrylic resin as a binder resin.

13. The image forming apparatus according to claim 1, wherein the toner particles include a polyester resin as a binder resin.

14. A process cartridge detachably attachable to an image forming apparatus, the process cartridge comprising:

a developing unit that includes an electrostatic image developer including a toner and develops an electrostatic latent image formed on a surface of an image holding member with the electrostatic image developer to form a toner image; and a cleaning unit that removes toner particles present on the surface of the image holding member, the cleaning unit including a cleaning blade arranged to contact with the surface of the image holding member, the cleaning unit including a cleaning blade and is configured such that either the cleaning blade contains a contacting portion having a JIS-A hardness of 90° or more, or the cleaning unit includes a control unit that controls a load with which the cleaning blade contacts with the image holding member, the control unit controlling the load in a constant load mode, the toner including toner particles; and silica particles having an average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more.

* * * * *